US009656820B2

(12) United States Patent
Yoshimura et al.

(10) Patent No.: US 9,656,820 B2
(45) Date of Patent: May 23, 2017

(54) SHEET CONVEYING APPARATUS WHICH DETECTS MULTIPLE FEED

(71) Applicant: KONICA MINOLTA, INC., Chiyoda-ku, Tokyo (JP)

(72) Inventors: Kazutoshi Yoshimura, Toyokawa (JP); Akinori Kimata, Toyokawa (JP); Takashi Watanabe, Toyokawa (JP); Toshikazu Higashi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/839,757

(22) Filed: Aug. 28, 2015

(65) Prior Publication Data

US 2016/0060056 A1 Mar. 3, 2016

(30) Foreign Application Priority Data

Sep. 2, 2014 (JP) ..... 2014-178454

(51) Int. Cl.
*B65H 7/06* (2006.01)
*B65H 7/12* (2006.01)
(Continued)

(52) U.S. Cl.
CPC ..... *B65H 7/125* (2013.01); *B65H 5/062* (2013.01); *B65H 7/06* (2013.01); *B65H 7/12* (2013.01);
(Continued)

(58) Field of Classification Search
CPC ..... B65H 2553/30; B65H 7/12; B65H 7/125; B65H 7/18; B65H 7/20
See application file for complete search history.

(56) References Cited

U.S. PATENT DOCUMENTS 7,425,001 B2 * 9/2008 Sano ..... B65H 7/125 271/10.01
7,690,650 B2 * 4/2010 Itoh ..... B65H 3/565 271/262
(Continued)

FOREIGN PATENT DOCUMENTS

JP 03293245 A 12/1991
JP 2008120493 A 5/2008
JP 2014120952 A 6/2014

OTHER PUBLICATIONS

Japanese Office Action (and English translation thereof) dated Nov. 8, 2016 issued in Japanese counterpart Application No. 2014-178454.

*Primary Examiner* — Jeremy R Severson
(74) *Attorney, Agent, or Firm* — Holtz, Holtz & Volek PC

(57) ABSTRACT

An image forming apparatus as a sheet conveying apparatus comprises a paper feeding roller, an upstream side sensor, and an ultrasonic wave sensor. The paper feeding roller provides a plurality of sheets placed on a document tray in series to a conveying path. The upstream side sensor detects presence or absence of a sheet being conveyed along the conveying path, at a location of a downstream side of the paper feeding roller along the conveying path. The ultrasonic wave sensor detects presence or absence of occurrence of multiple feed, based on intensity of ultrasonic waves received at a location of a downstream side of the upstream side sensor along the conveying path.

16 Claims, 37 Drawing Sheets

(51) Int. Cl.
*B65H 7/18* (2006.01)
*B65H 5/06* (2006.01)

(52) U.S. Cl.
CPC ..... *B65H 7/18* (2013.01); *B65H 2511/10* (2013.01); *B65H 2511/20* (2013.01); *B65H 2513/10* (2013.01); *B65H 2513/53* (2013.01); *B65H 2553/30* (2013.01); *B65H 2553/82* (2013.01); *B65H 2701/1311* (2013.01); *B65H 2701/1313* (2013.01); *B65H 2801/06* (2013.01); *B65H 2801/39* (2013.01)

(56) References Cited

U.S. PATENT DOCUMENTS

2003/0094748 A1* 5/2003 Chujo ..... B65H 7/02 271/262
2011/0127712 A1* 6/2011 Komuro ..... B65H 3/0684 271/110
2014/0062009 A1* 3/2014 Hongo ..... B65H 3/063 271/258.01
2014/0210152 A1* 7/2014 Kakuta ..... B65H 7/125 271/3.16

* cited by examiner

T=0

T=T1

SHEET CONVEYING APPARATUS WHICH DETECTS MULTIPLE FEED

This application is based on Japanese Patent Application No. 2014-178454 filed with the Japan Patent Office on Sep. 2, 2014, the entire content of which is hereby incorporated by reference.

BACKGROUND OF THE INVENTION

Field of the Invention

This invention relates to a sheet conveying apparatus, a control method of a sheet conveying apparatus, and a control program of a sheet conveying apparatus. More specifically, this invention relates to a sheet conveying apparatus, a control method of a sheet conveying apparatus, and a control program of a sheet conveying apparatus which can recognize a state of sheet conveying with more precision.

Description of the Related Art

Some image forming apparatuses such as MFPs (Multi-function Peripherals), facsimile devices and copying machines or scanner devices have a sheet conveying apparatus, such as an ADF (Auto Document Feeder) or the like. An image forming apparatus having a sheet conveying apparatus can automatically execute printing on sheets, with conveying a plurality of sheets stored in a paper feeding cartridge one by one. A scanner device having a sheet conveying apparatus can automatically read document images by a scanner, with conveying a plurality of documents set on a document tray one by one.

Multiple feed may occur in a sheet conveying apparatus at rare intervals. Multiple feed is a phenomenon in which more than one sheets are overlapped each other and conveyed simultaneously. To prevent the multiple feed, a technique is proposed. According to the technique, a sensor which electrically or mechanically detects sheets passing through a conveying path is provided in the conveying path, and a multiple feed is detected based on the detection timing of the sensor. According to another technique proposed, an ultrasonic wave sensor (a multiple feed detection sensor of an ultrasonic wave type) is provided in a conveying path, and a multiple feed is detected based on the change in the quantity of transmission of ultrasonic waves which is transmitted through a sheet.

FIG. 32 shows a conventional technique using a detection sensor for detecting sheets passing through a conveying path. In FIGS. 32 to 37, arrow AR101 shows a conveying direction of documents in the conveying path.

Referring to FIG. 32, document tray 1005 holds a plurality of documents (sheets) DT. From the upstream side to the downstream side in conveying path TR, upstream side roller 1001, upstream side sensor 1002, downstream side sensor 1003, and downstream side roller 1004 are placed in this order. A plurality of documents DT stored in document tray 1005 are fed one by one into conveying path TR by upstream side roller 1001. Documents fed into conveying path TR are conveyed along conveying path TR, by each of upstream side roller 1001 and downstream side roller 1004.

The sheet conveying apparatus predicts the location of the document being conveyed, by using a rotational speed of upstream side roller 1001 with reference to a clock time when upstream side sensor 1002 detects the anterior end of a document (a clock time when upstream side sensor 1002 is turned on). Then, the sheet conveying apparatus detects the presence or absence of a multiple feed, based on whether upstream side sensor 1002 detects the posterior end of the document (whether upstream side sensor 1002 is turned off) or not, at the estimated time when the posterior end of the document is expected to pass through upstream side sensor 1002.

FIG. 33 shows a conventional technique using an ultrasonic wave sensor.

Referring to FIG. 33, document tray 1005 holds a plurality of documents DT. From the upstream side to the downstream side in conveying path TR, upstream side roller 1001, ultrasonic wave sensor 1006, and downstream side roller 1004 are placed in this order. Ultrasonic wave sensor 1006 includes transmitting unit 1007 for transmitting ultrasonic waves as shown by arrow AR102, and receiving unit 1008 for receiving the ultrasonic waves from transmitting unit 1007. Transmitting unit 1007 and receiving unit 1008 face each other, interposing conveying path TR. A plurality of documents DT stored in document tray 1005 are fed one by one into conveying path TR by upstream side roller 1001.

When a document passes the detecting location of ultrasonic wave sensor 1006, a part of the ultrasonic waves from transmitting unit 1007 reflect by the document. In consequence, the intensity of the ultrasonic waves being received by receiving unit 1008 decreases. Herewith, the sheet conveying apparatus detects the passage of the anterior end of the document through the detecting location. When a plurality of documents simultaneously pass through the detecting location of the ultrasonic wave sensor, the ultrasonic waves reflect by the plurality of documents. In this case, the intensity of the ultrasonic waves being received by receiving unit 1008 further decreases. Herewith, the sheet conveying apparatus can detect the occurrence of the multiple feed. The sheet conveying apparatus can also detect the anterior end of the preceding document and the deviation amount.

Document 1 below discloses a technique using an ultrasonic wave sensor, for example. In the Document 1 below, by using an ultrasonic wave sensor, the sheet conveying apparatus detects the leading end of a sheet of paper being conveyed, the leading end of the multiple feed part, the posterior end of the multiple feed part, the posterior end of the document, or the like. Herewith, the sheet conveying apparatus calculates the overlapping width of the multiple feed, and switches the multiple feed separating process after detecting the multiple feed, in response to the overlapping width.

[Document 1] Japan Patent Publication No. 2008-120493

The conventional technique using a detection sensor, and the conventional technique using an ultrasonic wave sensor have problems as follows.

FIGS. 34 and 35 are for explanation pertaining to problems of a conventional technique having a detection sensor for detecting sheets passing through a conveying path.

Referring to FIG. 34, it is assumed that the deviation amount is small (the overlapping width of the documents is large) in case of the occurrence of the multiple feed. In this case, the posterior end of document DT1 and the posterior end of document DT2 almost simultaneously pass through the detecting location of upstream side sensor 1002, at the estimated time when the posterior end of document DT1 is expected to pass through the detecting location of upstream side sensor 1002. Therefore, according to the conventional technique using the detection sensor, the occurrence of the multiple feed can not be detected in case that the overlapping width of the documents is large.

Referring to FIG. 35, in the conventional technique, the presence or absence of the multiple feed of document DT1 can not be detected until the estimated time when the posterior end of document DT1 is expected to pass through the detecting location of upstream side sensor 1002. Therefore, when the sheet conveying apparatus detects the occurrence of the multiple feed, the anterior end of document DT1 reaches at the inner part of the sheet conveying apparatus (the location downstream from downstream side roller 1004). Since the image reading of the anterior end of the document DT1 has already started, the read image data should be deleted. Further, the anterior end of document DT1 is damaged.

FIGS. 36 and 37 are for explanation pertaining to problems in a conventional technique using an ultrasonic wave sensor.

Referring to FIG. 36, ultrasonic waves have both directional characteristics and characteristics of diffraction. Hence, even though the anterior end of document DT1 reaches the detecting location of ultrasonic wave sensor 1006, the ultrasonic waves from transmitting unit 1007 sneak around to the back of the anterior end of document DT1 and enter receiving unit 1008, as shown by arrow AR103. Namely, there is a time lag (a delay in response) between the clock time when the anterior end of document DT1 is detected (and the clock time when the occurrence of the multiple feed is detected) and the clock time when the intensity of the ultrasonic waves received by receiving unit 1008 decreases in reality. In consequence, in case that an ultrasonic wave sensor is independently used, the accuracy to detect the anterior end of the document and the starting location of the multiple feed is poor.

Referring to FIG. 37, when an overlapping quantity of document DT1 and document DT2 is small, the ultrasonic waves from transmitting unit 1007 sneak around to the back of the overlapping part of the documents, and enter receiving unit 1008, as shown by arrow AR104. In consequence, the intensity of the ultrasonic waves received by receiving unit 1008 almost does not decrease from the intensity with no multiple feed (from the intensity of the ultrasonic waves passed through a single sheet of a document). Hence, the presence or absence of the multiple feed can not be detected.

SUMMARY OF THE INVENTION

This invention is achieved to solve the above problems. The object is to provide a sheet conveying apparatus, a control method of a sheet conveying apparatus, and a control program of a sheet conveying apparatus, which can recognize a state of sheet conveying with more precision.

The other object of this invention is to provide a sheet conveying apparatus, a control method of a sheet conveying apparatus, and a control program of a sheet conveying apparatus, which can quickly detect the occurrence of a multiple feed.

According to one aspect of this invention, a sheet conveying apparatus comprises: an upstream side roller to provide a plurality of sheets placed on a placement unit in series to a conveying path; an upstream side sensor to detect presence or absence of a sheet being conveyed along the conveying path, at a location of a downstream side of the upstream side roller along the conveying path; and an ultrasonic wave sensor to detect presence or absence of occurrence of multiple feed, based on intensity of ultrasonic waves received at a location of a downstream side of the upstream side sensor along the conveying path.

According to another aspect of this invention, a method of controlling a sheet conveying apparatus having an upstream side roller to provide a plurality of sheets placed on a placement unit in series to a conveying path, an upstream side sensor, and an ultrasonic wave sensor, the method comprising the steps of: detection by using the upstream side sensor, presence or absence of a sheet being conveyed along the conveying path, at a location of a downstream side of the upstream side roller along the conveying path, and detection presence or absence of occurrence of multiple feed, based on intensity of ultrasonic waves received by the ultrasonic wave sensor at a location of a downstream side of the upstream side sensor along the conveying path.

According to another aspect of this invention, a non-transitory computer-readable recording medium storing a controlling program for a sheet conveying apparatus having an upstream side roller to provide a plurality of sheets placed on a placement unit in series to a conveying path, an upstream side sensor, and an ultrasonic wave sensor, the program causing a computer to execute the steps of: detection by using the upstream side sensor, presence or absence of a sheet being conveyed along the conveying path, at a location of a downstream side of the upstream side roller along the conveying path, and detection presence or absence of occurrence of multiple feed, based on intensity of ultrasonic waves received by the ultrasonic wave sensor at a location of a downstream side of the upstream side sensor along the conveying path.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiment of this invention will be explained in the followings, based on the drawings.

In the following embodiment, the situation in which a sheet conveying apparatus is an image forming apparatus will be explained. The image forming apparatus may be a MFP having a scanner function, a copying function, a function of a printer, a facsimile function, a data transmitting function, and a server function. The image forming apparatus may be a facsimile device, a copying machine, or the like. The sheet conveying apparatus may be a scanner device or the like, other than an image forming apparatus.

In the description, to explain multiple fed documents, a multiple fed document at a downstream side may be referred to as the preceding document or document DT1. To explain multiple fed documents, a multiple fed document at an upstream side (the document dragged by the preceding document, and caused the multiple feed) may be referred to as the following document or document DT2. To explain multiple fed documents, the distance between the anterior end of the preceding document and the anterior end of the following document may be referred to as the deviation amount.

[The Structure of the Image Forming Apparatus]

Firstly, the structure of the image forming apparatus in the embodiment will be explained.

Figure 1:
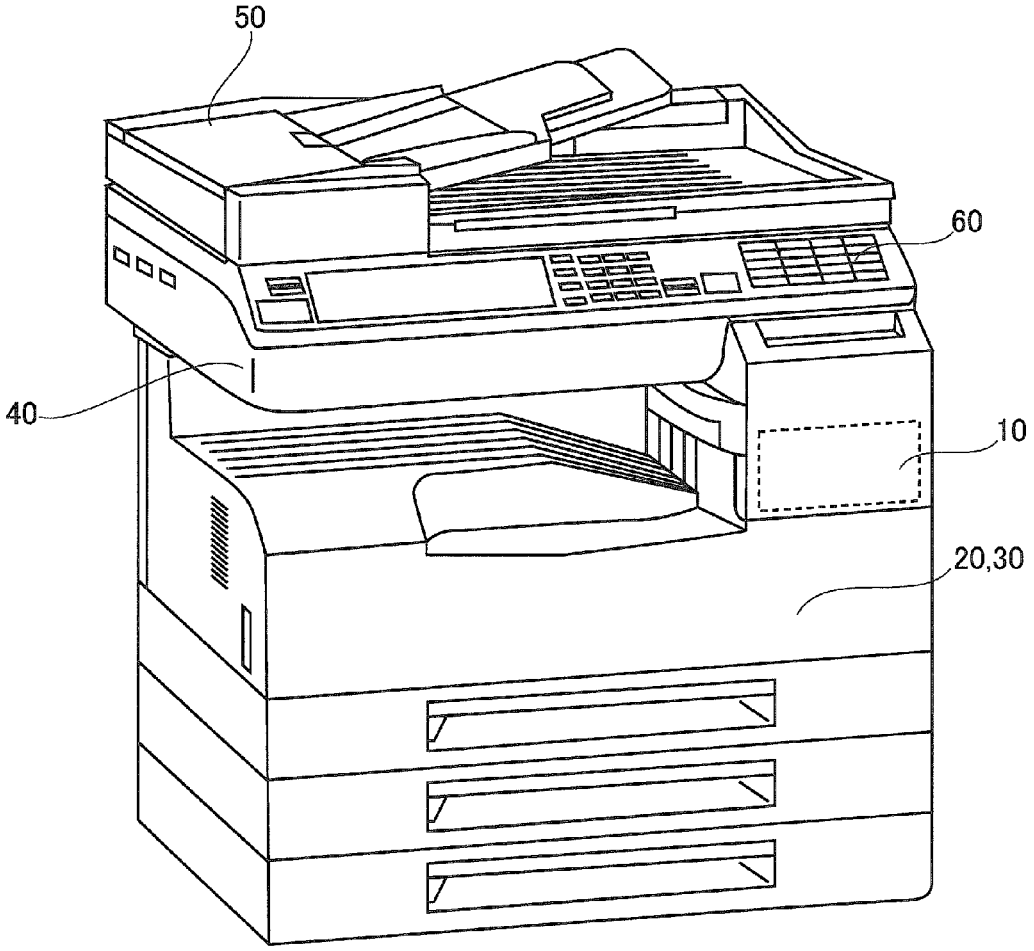
FIG. 1 shows a perspective view of a structure of an image forming apparatus, according to the embodiment of this invention.

FIG. 1 shows a perspective view of a structure of an image forming apparatus, according to the embodiment of this invention.

Referring to FIG. 1, the image forming apparatus (an example of a sheet conveying apparatus) is a MFP which is equipped with control unit 10, image forming unit 20, paper feeding unit 30, scanner unit 40, ADF (Auto Document Feeder) unit 50, and operation panel 60. Control unit 10, image forming unit 20, and paper feeding unit 30 are placed at the center of the image forming apparatus. Scanner unit 40 and ADF unit 50 are placed at an upper part of the image forming apparatus. Operation panel 60 is placed at a front upper part of the image forming apparatus.

Figure 2:
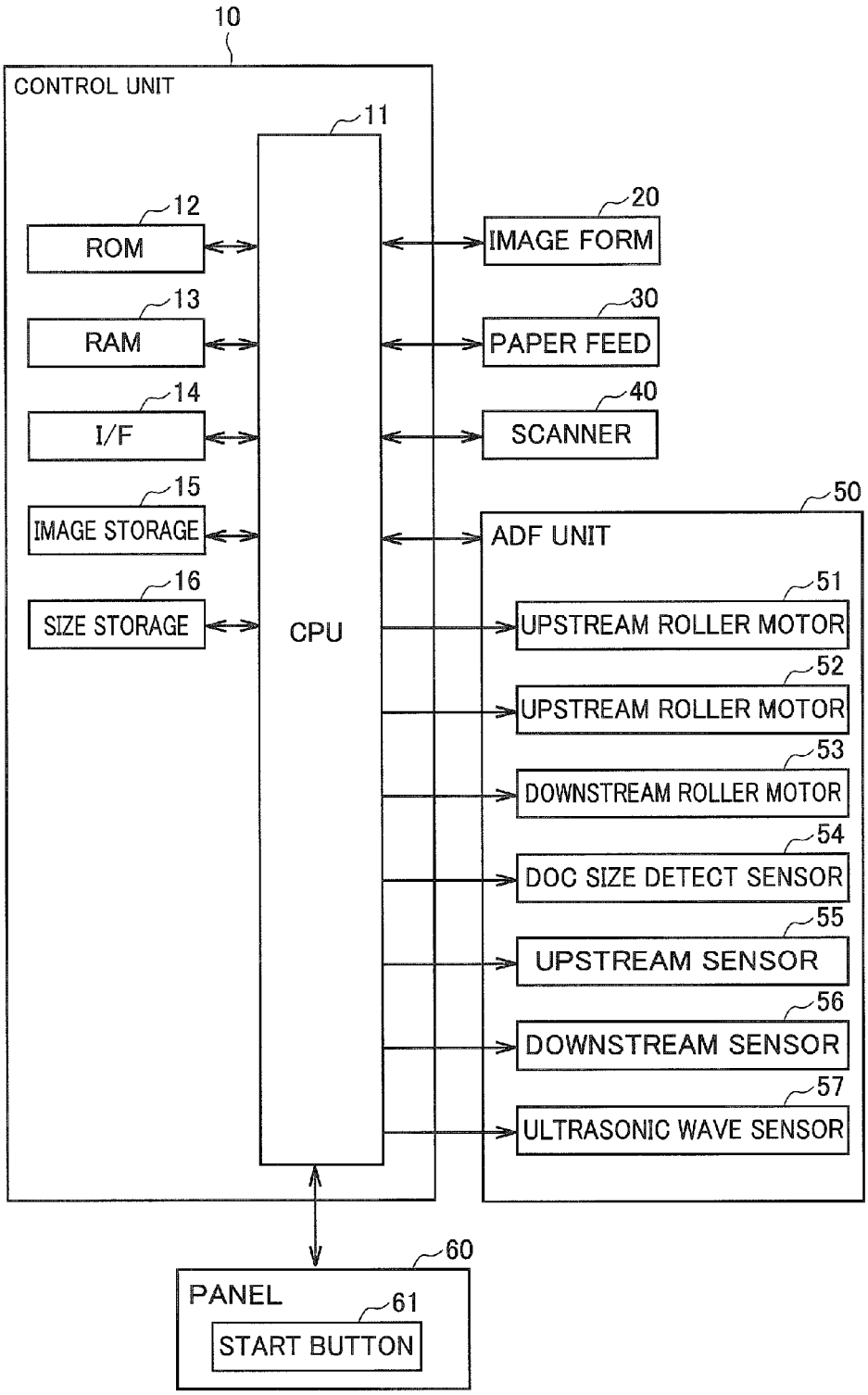
FIG. 2 shows a block diagram of a structure of the image forming apparatus of the embodiment of this invention.

FIG. 2 shows a block diagram of a structure of the image forming apparatus of the embodiment of this invention.

Referring to FIG. 2, control unit 10 includes CPU (Central Processing Unit) 11, ROM (Read Only Memory) 12, RAM (Random Access Memory) 13, communication I/F unit 14, image data storage unit 15, and document size storage unit 16. CPU 11 and each of ROM 12, RAM 13, communication I/F unit 14, image data storage unit 15, and document size storage unit 16 are connected with each other. CPU 11 controls the behavior of the entire image forming apparatus. ROM 12 stores control programs to be executed by CPU 11. RAM 13 is a working memory for CPU 11. Communication I/F 14 transmits and receives various kinds of information with external devices which are not shown in the drawing, via a network or the like. Image data storage unit 15 stores image data read by scanner unit 40 or the like. Document size storage unit 16 stores the document size measured by ADF unit 50, and the document size set by operation panel 60.

Image forming unit 20 is roughly configured with a toner image forming unit, a fixing device, or the like. Image forming unit 20 forms (prints) images on sheets by an electrophotographic technology, for example. Image forming unit 20 synthesizes 4 color images by so-called a tandem system, and forms color images on sheets. The toner image forming unit is configured with photo conductors for C (cyan), M (magenta), Y (yellow), and K (black), a secondary transfer belt to which toner images are transferred (the first transfer) from the photo conductors, a transfer unit for transferring images (the second transfer) from the secondary transfer belt to sheets, or the like. The fixing device has a heating roller and a pressure roller. The fixing device pinches and conveys sheets on which toner images were formed, by using the heating roller and the pressure roller, and heats and applies pressure to the sheets. Herewith, the fixing device melts toner adhered to the sheets and fixes the toner on the sheets, to form images on the sheets.

Paper feeding unit 30 is configured with a paper feeding roller, a conveying roller, motors for driving the rollers, or the like. Paper feeding unit 30 feeds sheets of paper from a paper feeding cartridge (not shown in Figures), and conveys them in the inner part of a chassis of the image forming apparatus. Paper feeding unit 30 discharges sheets on which images were formed, from the image forming apparatus to a copy receiving tray or the like.

Scanner unit 40 reads images of documents and generates image data of the documents.

ADF unit 50 feeds documents (examples of sheets) one by one into scanner unit 40. ADF unit 50 includes upstream side roller drive motors 51 and 52, downstream side roller drive motor 53, document size detection sensor 54, upstream side sensor 55, downstream side sensor 56, and ultrasonic wave sensor 57. Upstream side roller drive motors 51 and 52, downstream side roller drive motor 53, document size detection sensor 54, upstream side sensor 55, downstream side sensor 56, and ultrasonic wave sensor 57 work based on control of CPU 11.

Figure 3:
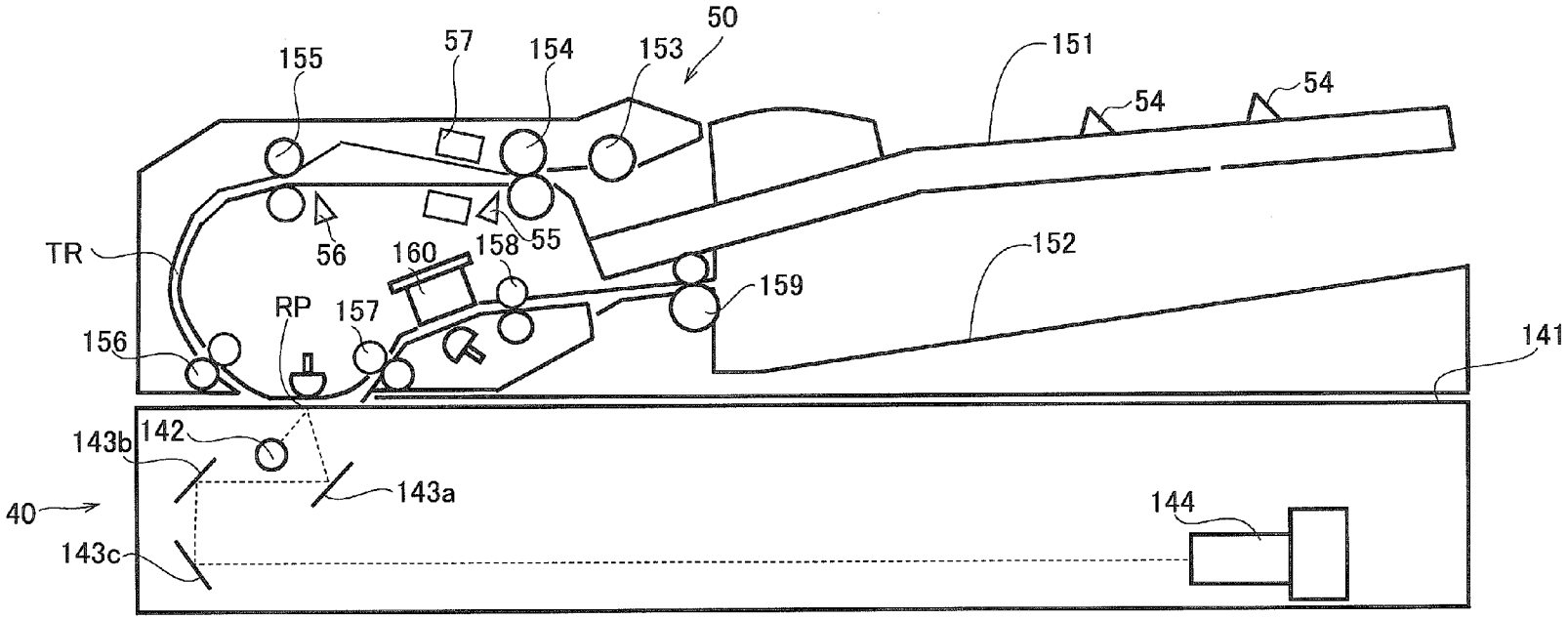
FIG. 3 shows the inner structure of scanner unit 40 and ADF unit 50.

Each of upstream side roller drive motors 51 and 52 drives an upper roller and a lower roller which form paper feeding roller 154 (FIG. 3). Downstream side roller drive motor 53 drives conveying rollers 155 to 158 and paper ejection roller 159 (FIG. 3). Document size detection sensor 54 detects the size of a document stacked on document tray 151 (FIG. 3).

Upstream side sensor 55 and downstream side sensor 56 optically or mechanically detect the presence or absence of a document at each detecting location of upstream side sensor 55 and downstream side sensor 56 along the conveying path.

Ultrasonic wave sensor 57 outputs an electrical voltage value corresponding to the intensity of the ultrasonic waves received. CPU 11 detects the presence or absence of multiple feed, based on the electrical voltage value of ultrasonic wave sensor 57.

Operation panel 60 displays various information and receives various operations. Operation panel 60 includes start button 61 for starting various jobs, for example, a reading job, a coping job, or the like.

FIG. 3 shows the inner structure of scanner unit 40 and ADF unit 50.

Referring to FIG. 3, at the top of scanner unit 40, ADF unit 50 is placed. Scanner unit 40 can read a document placed on platen 141, and can read a document fed from ADF unit 50.

Scanner unit 40 includes platen 141, light source 142, mirrors 143*a*, 143*b* and 143*c*, and CCD (Charge Coupled Device) 144. The light emitted from light source 142 and reflected by the surface of the document is reflected by each of mirrors 143*a*, 143*b* and 143*c* and enters CCD 144. Herewith, scanner unit 40 reads documents.

ADF unit 50 includes document tray 151 (an example of a placement unit), copy receiving tray 152, pickup roller 153, paper feeding roller 154 (an example of an upstream side roller), conveying roller 155 (an example of a downstream side roller), 156, 157 and 158, paper ejection roller 159, and CIS (Contact Image Sensor) 160. Documents to be read are placed (held) on document tray 151. On the top surface of document tray 151, document size detection sensors 54 which mechanically detect the documents are installed. The size of the placed document is measured based on the detection result of document size detection sensor 54. Documents on which the images were read are discharged from ADF unit 50 to copy receiving tray 152.

In ADF unit 50, conveying path TR which connects document tray 151 and copy receiving tray 152 is provided. Pickup roller 153, paper feeding roller 154, conveying rollers 155, 156, 157 and 158, and paper ejection roller 159 are placed in this order from document tray 151 to copy receiving tray 152, along conveying path TR. Between conveying roller 156 and conveying roller 157, reading position RP is placed. Between conveying roller 157 and conveying roller 158, CIS 160 is provided.

ADF unit 50 provides documents placed on document tray 151 one by one in series for conveying path TR, by using pickup roller 153 and paper feeding roller 154. ADF unit 50 performs registration correction with respect to documents provided in conveying path TR by using conveying roller 155. ADF unit 50 conveys documents provided in conveying path TR to reading position RP along conveying path TR, by conveying rollers 155 and 156. Scanner unit 40 reads the surface of the document conveyed at reading position RP. Next, ADF unit 50 conveys the document of which the surface was read to CIS 160 along conveying path TR, by conveying roller 157. Scanner unit 40 reads the surface of the conveyed document by CIS 160. After that, ADF unit 50 conveys the document to the discharge outlet along conveying path TR by conveying roller 158. ADF unit 50 discharges the document onto copy receiving tray 152 by paper ejection roller 159.

In conveying path TR, upstream side sensor 55, downstream side sensor 56, and ultrasonic wave sensor 57 are further placed. Upstream side sensor 55 detects the presence or absence of the document being conveyed along conveying path TR at the detecting location which is a downstream side of paper feeding roller 154 along conveying path TR. Ultrasonic wave sensor 57 detects the presence or absence of multiple feed at the detecting location which is a downstream side of upstream side sensor 55 along conveying path TR, based on the intensity of the ultrasonic waves received. Downstream side sensor 56 detects the presence or absence of the document being conveyed along conveying path TR at the detecting location along conveying path TR between ultrasonic wave sensor 57 and conveying roller 155. ADF unit 50 controls paper feeding timing of the document by using upstream side sensor 55.

[The Behavior of the Ultrasonic Wave Sensor]

Next, the behavior of the ultrasonic wave sensor will be explained.

Figure 4:
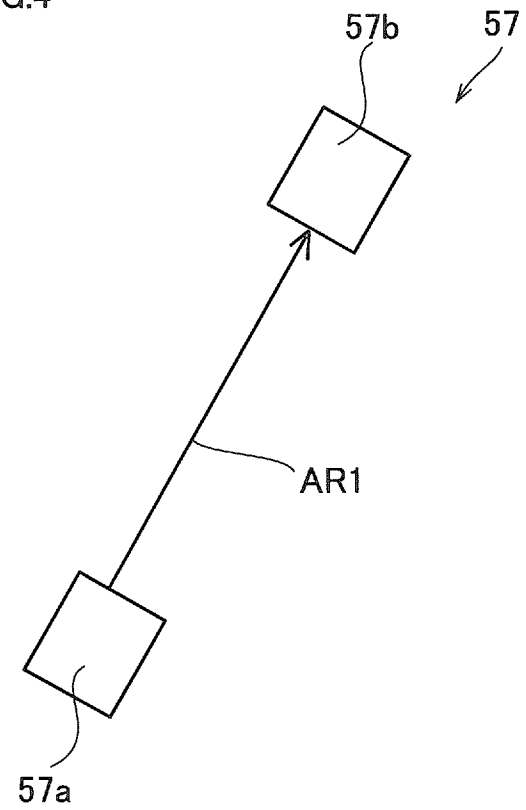
FIGS. 4 to 6 are for explanation pertaining to behavior of ultrasonic wave sensor 57.
Figure 5:
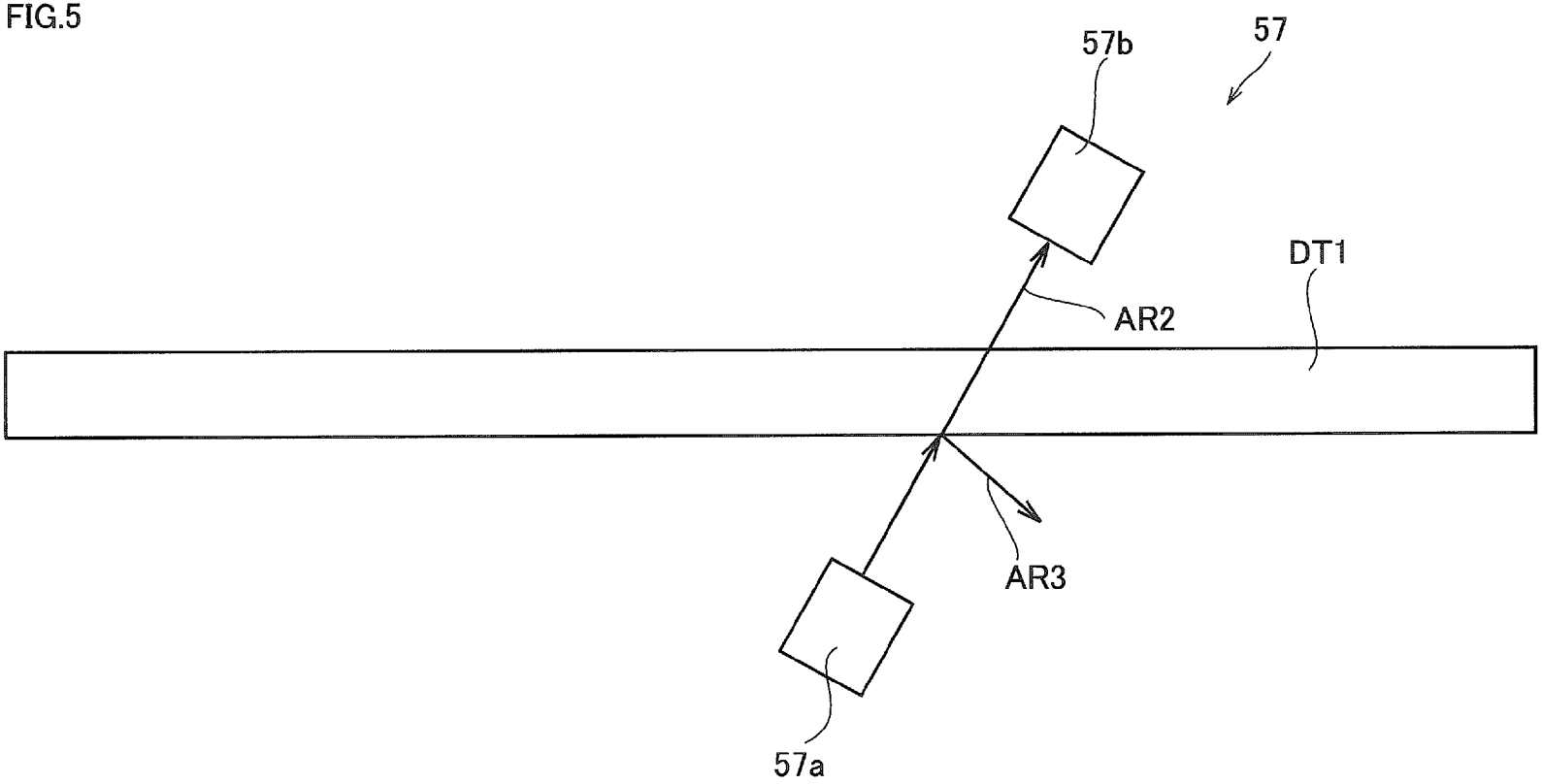
Figure 6:
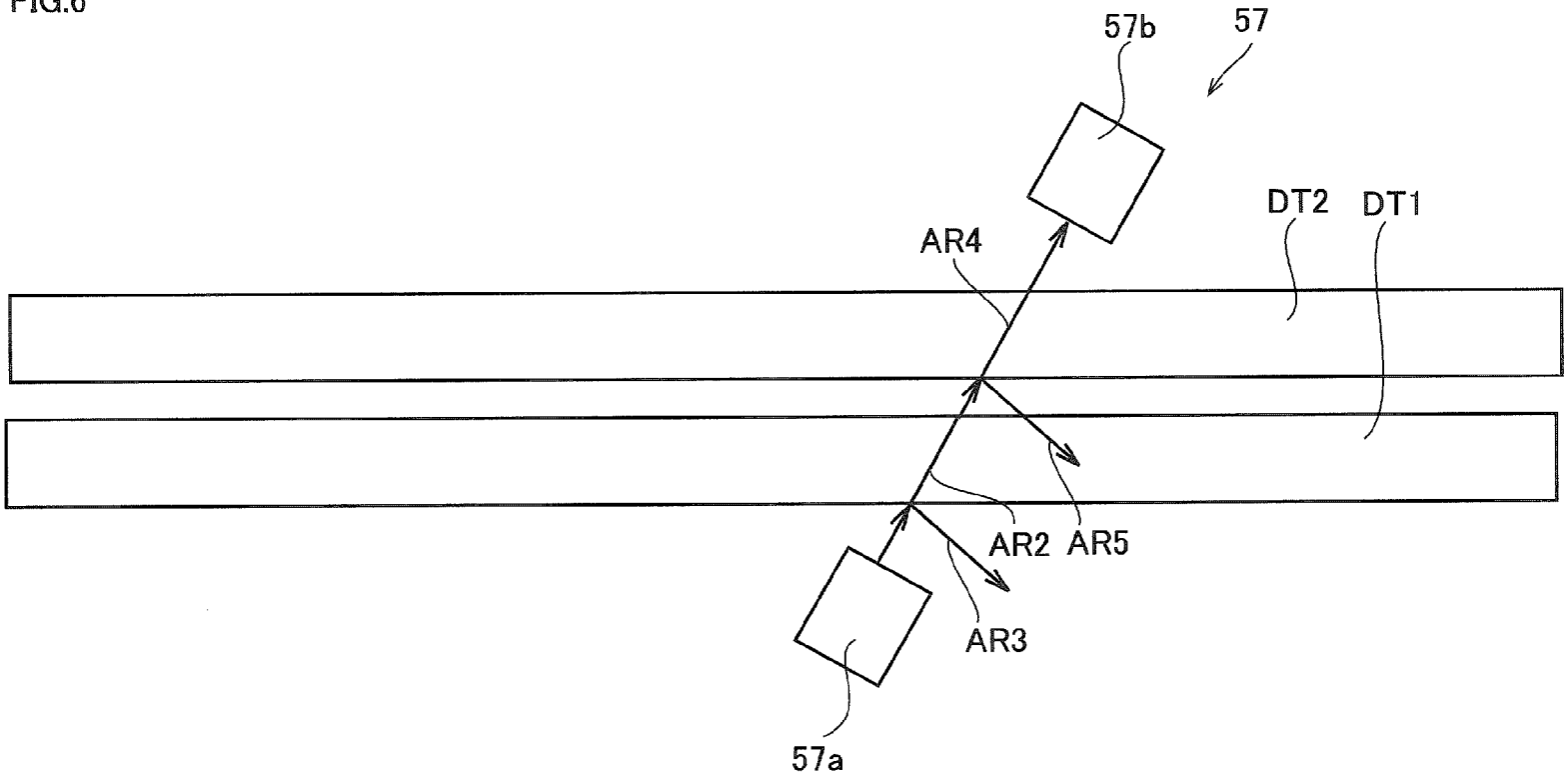

FIGS. 4 to 6 are for explanation pertaining to behavior of ultrasonic wave sensor 57.

Referring to FIG. 4, ultrasonic wave sensor 57 includes transmitting unit 57*a* which transmits ultrasonic waves, and receiving unit 57*b* which receives ultrasonic waves from transmitting unit 57*a*. Transmitting unit 57*a* and receiving unit 57*b* face each other. The image forming apparatus determines the occurrence or absence of multiple feed, based on the transmissive amount of ultrasonic waves transmitted through the document. The transmissive amount of ultrasonic waves differs depending on the document types.

When there is not a document between transmitting unit 57*a* and receiving unit 57*b*, almost all the ultrasonic waves from transmitting unit 57*a* are received by receiving unit 57*b*, as shown by arrow AR1. The intensity of the ultrasonic waves received by receiving unit 57*b* will be the highest.

Referring to FIG. 5, when document DT1 is conveyed between transmitting unit 57*a* and receiving unit 57*b*, ultrasonic waves from transmitting unit 57*a* are divided into transmitted waves as shown by arrow AR2 and reflected waves as shown by arrow AR3 at the surface of document DT1. Receiving unit 57*b* receives only the transmitted waves as shown by arrow AR2. The intensity of the ultrasonic waves received by receiving unit 57*b* will be lower than the intensity of FIG. 4.

Referring to FIG. 6, when multiple fed documents DT1 and DT2 are conveyed between transmitting unit 57*a* and receiving unit 57*b*, transmitted waves through document DT1 as shown by arrow AR2 are further divided into transmitted waves as shown by arrow AR4 and reflected waves as shown by arrow AR5 at the surface of document DT2. Receiving unit 57*b* receives only the transmitted waves as shown by arrow AR4. The intensity of the ultrasonic waves received by receiving unit 57*b* will be lower than the intensity of FIG. 5.

Figure 7:
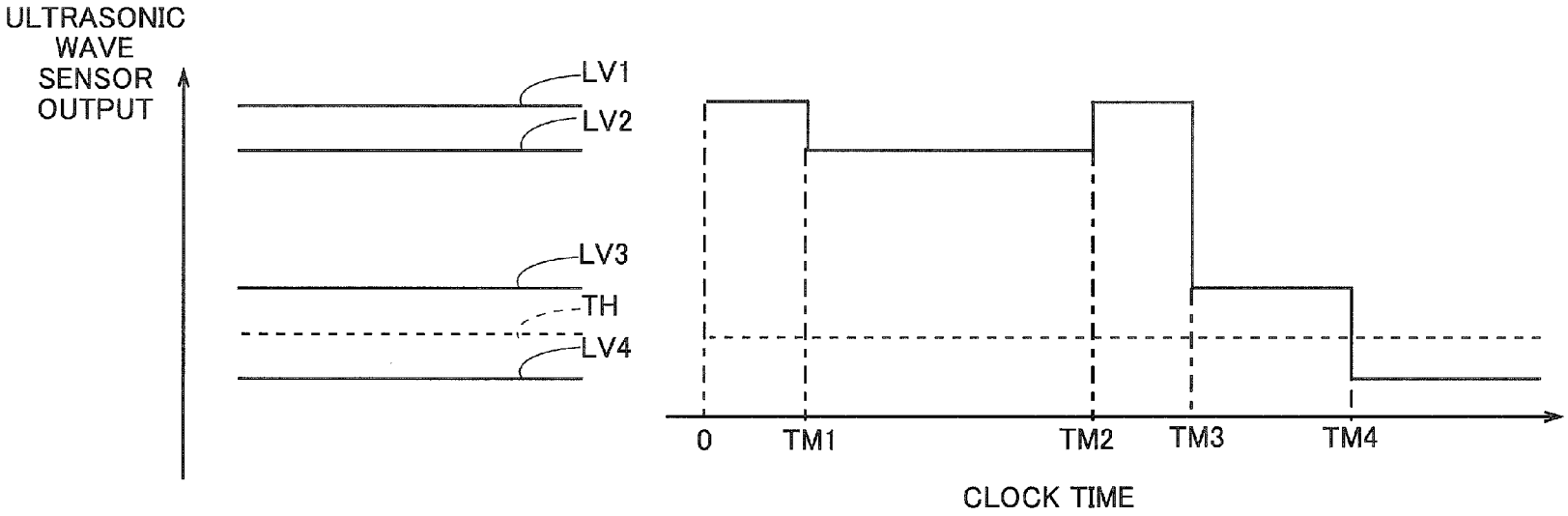
FIG. 7 schematically shows alteration of the intensity of the ultrasonic waves being received by receiving unit 57*b* of ultrasonic wave sensor 57 from moment to moment.

FIG. 7 schematically shows alteration of the intensity of the ultrasonic waves being received by receiving unit 57*b* of ultrasonic wave sensor 57 from moment to moment.

Referring to FIG. 7, threshold value TH with respect to an electrical voltage value (an output value) output from ultrasonic wave sensor 57 is beforehand set, and stored in ROM 12 or the like. Threshold value TH is preferably set at a value corresponding to the type (transmissiveness of ultrasonic waves) of the document. The image forming apparatus may beforehand acquire information related to the type of the document.

From clock time 0 to clock time TM1, a document is not passing the detecting location of ultrasonic wave sensor 57. Hence, the electrical voltage value of ultrasonic wave sensor 57 is a maximum level LV1.

From clock time TM1 to clock time TM2, a thin document is passing the detecting location of ultrasonic wave sensor 57. Hence, the electrical voltage value of ultrasonic wave sensor 57 is level LV2 which is lower than level LV1.

After the thin document passed over the detecting location of ultrasonic wave sensor 57 at clock time TM2, a document is not passing the detecting location of ultrasonic wave sensor 57 from clock time TM2 to clock time TM3. Hence, the electrical voltage value of ultrasonic wave sensor 57 recovers the maximum level LV1.

From clock time TM3 to clock time TM4, a thick document is passing the detecting location of ultrasonic wave sensor 57. Hence, the electrical voltage value of ultrasonic wave sensor 57 is level LV3 which is lower than level LV2.

At clock time TM4, another document is passing the detecting location of ultrasonic wave sensor 57 with the thick document. Hence, the electrical voltage value of ultrasonic wave sensor 57 is level LV4 which is lower than level LV3.

Since levels LV1, LV2, and LV3 are higher than threshold value TH, in case that ultrasonic wave sensor 57 outputs electrical voltage values of levels LV1, LV2, or LV3, the image forming apparatus does not detect multiple feed. On the other hand, since level LV4 is lower than threshold value TH, in case that ultrasonic wave sensor 57 outputs an electrical voltage value of level LV4, the image forming apparatus detects the occurrence of multiple feed.

Since the electrical voltage value (signal) output from ultrasonic wave sensor 57 is a small analog signal, the value is preferably amplified to be able to obtain adequately the difference of the output when multiple feed occurred. The degree of amplification may be determined by the quality of material of the document or the like.

[The Calculation Method of the Location of the Anterior End of the Document and the Deviation Amount]

Next, the calculation method of the location of the anterior end of the document and the starting point of multiple feed which the image forming apparatus performs will be explained.

Figure 8:
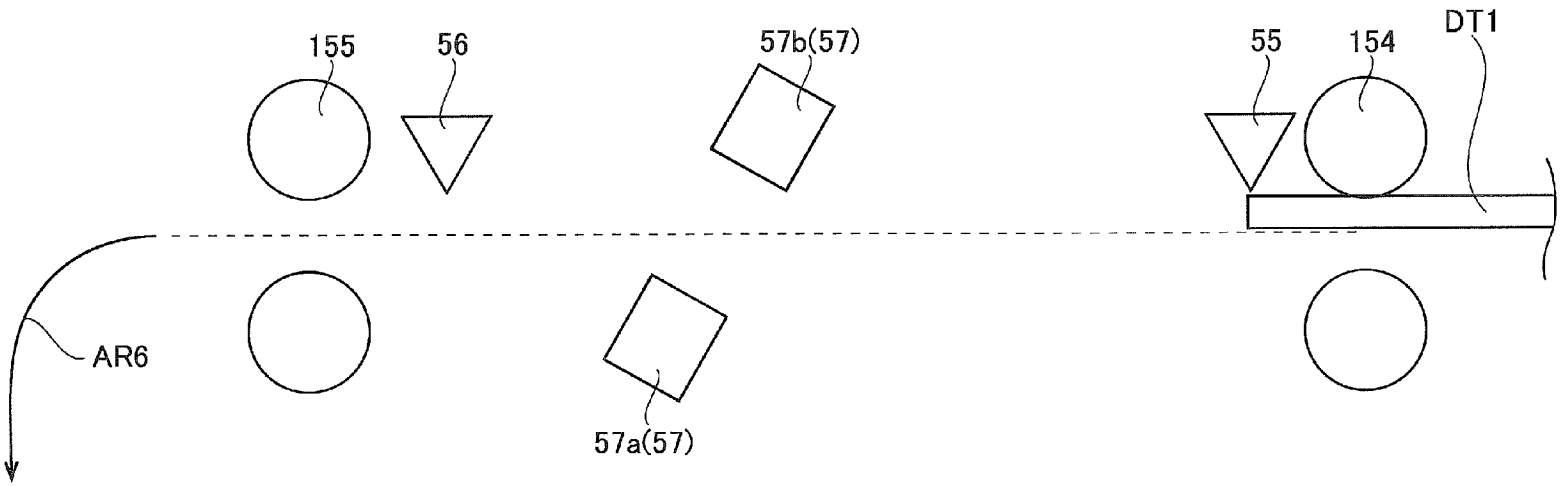
FIGS. 8 to 10 are for explanation pertaining to a calculation method for the location of the anterior end of the document and the deviation amount.
Figure 9:
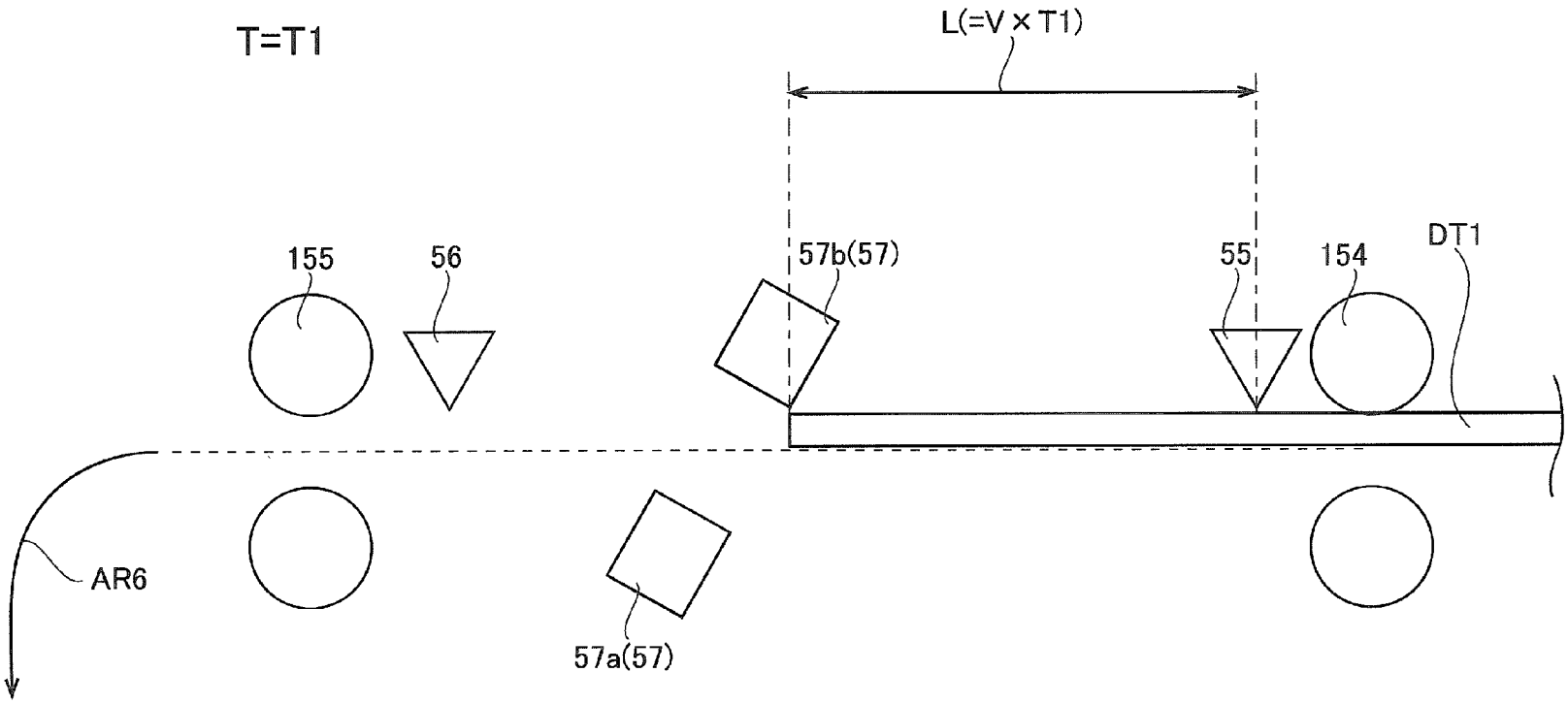
Figure 10:
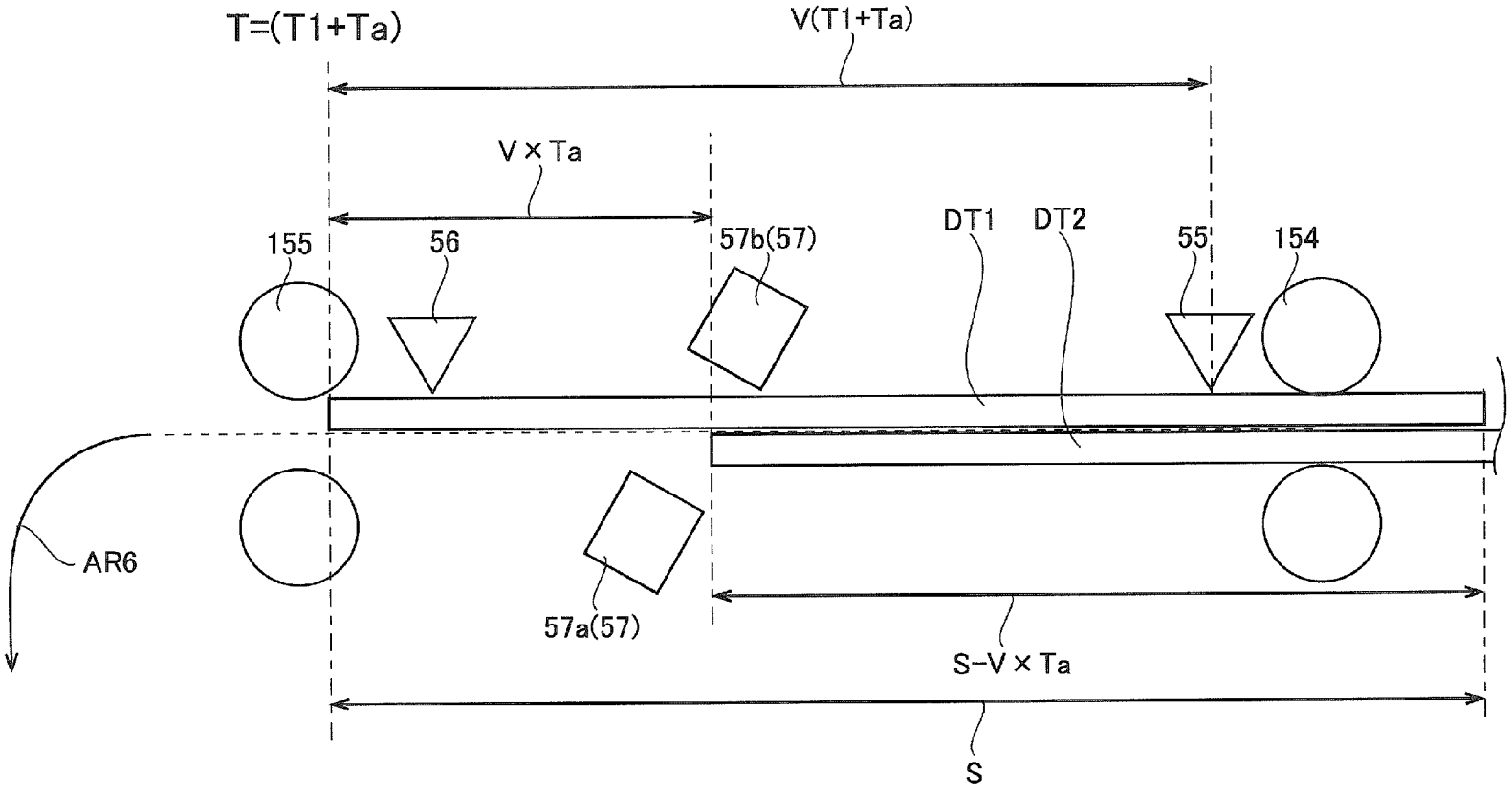

FIGS. 8 to 10 are for explanation pertaining to a calculation method for the location of the anterior end of the document and the deviation amount.

In the following Figures, the structure from paper feeding roller 154 to conveying roller 155 along conveying path TR is extracted from FIG. 3. In the following Figures, arrow AR6 shows a conveying direction of the document in conveying path TR. In the following explanations, paper feeding roller 154 in FIG. 3 may be referred to as upstream side roller 154, and conveying roller 155 may be referred to as downstream side roller 155.

Referring to FIG. 8, document DT1 is fed from document tray 151 by paper feeding roller 154. When the anterior end of document DT1 passes through the detecting location of upstream side sensor 55, the image forming apparatus detects the document by upstream side sensor 55 (upstream side sensor 55 becomes turned ON).

Referring to FIG. 9, the image forming apparatus calculates time T1 from when upstream side sensor 55 detects the anterior end of document DT1 till when the anterior end of document DT1 reaches the detecting location of ultrasonic wave sensor 57. Time T1 can be calculated by the following expression (1), in that the distance L is between the detecting location of upstream side sensor 55 and the detecting location of ultrasonic wave sensor 57, and velocity V is a velocity of conveying the document. Distance L and velocity V are known values. Distance L and velocity V are stored in ROM12 (FIG. 2), for example.

$$\text{Time } T1 = \text{distance } L / \text{velocity } V \quad (1)$$

The image forming apparatus can predict the location of the anterior end of document DT1 along conveying path TR, based on elapsed time T from when upstream side sensor 55 detected the anterior end of document DT1. The predicted location of the anterior end of document DT1 is calculated by the following expression (2).

$$\text{The predicted location of the anterior end of document } DT1 = \text{elapsed time } T * \text{velocity } V \quad (2)$$

Further, in case that length S of the document in the conveying direction is beforehand acquired by the detection result of document size detection sensor 54 or the like, the image forming apparatus can predict the location of the posterior end of the document. The predicted location of the posterior end of document DT1 is calculated by the following expression (3).

$$\text{The predicted location of the posterior end of document } DT1 = \text{elapsed time } T * \text{velocity } V - \text{length } S \quad (3)$$

The image forming apparatus may predict locations of arbitrary points of document DT1, other than the anterior end and the posterior end of document DT1.

Referring to FIG. 10, at the time when the period of time (T1+Ta) has elapsed from the time when upstream side sensor 55 detects the anterior end of document DT1, the image forming apparatus detects the occurrence of multiple feed by ultrasonic wave sensor 57. In case that the image forming apparatus detects the occurrence of multiple feed, the image forming apparatus calculates the location of the anterior end of document DT1 (the distance between the anterior end of document DT1 and the detecting location of upstream side sensor 55), and the deviation amount (the distance between the anterior end of document DT1 and the anterior end of document DT2). The location of the anterior end of document DT1 is calculated by the following expression (4). The deviation amount is calculated by the following expression (5), based on time Ta which is from the estimated time when the anterior end of the document is expected to reache the detecting location of the ultrasonic wave sensor till when the ultrasonic wave sensor detects the occurrence of multiple feed.

$$\text{The location of the anterior end of document } DT1 = \text{velocity } V * (\text{time } Ta + \text{time } T1) \quad (4)$$

$$\text{The deviation amount} = \text{velocity } V * \text{time } Ta \quad (5)$$

Further, in case that length S of the document in the conveying direction is beforehand acquired, the image forming apparatus calculates an overlapping quantity of the document. The overlapping quantity of the document is calculated by the following expression (6).

$$\text{The overlapping quantity of the document} = \text{length } S \text{ of the document in the conveying direction} - \text{velocity } V^{*}\text{time } Ta \quad (6)$$

[The Correction Method of the Location of the Anterior End of the Document and the Deviation Amount]

To make the image forming apparatus precisely predict the location of the anterior end of the document and the deviation amount, delay in response caused by characteristics of diffraction of ultrasonic waves may be corrected in the following method.

Figure 11:
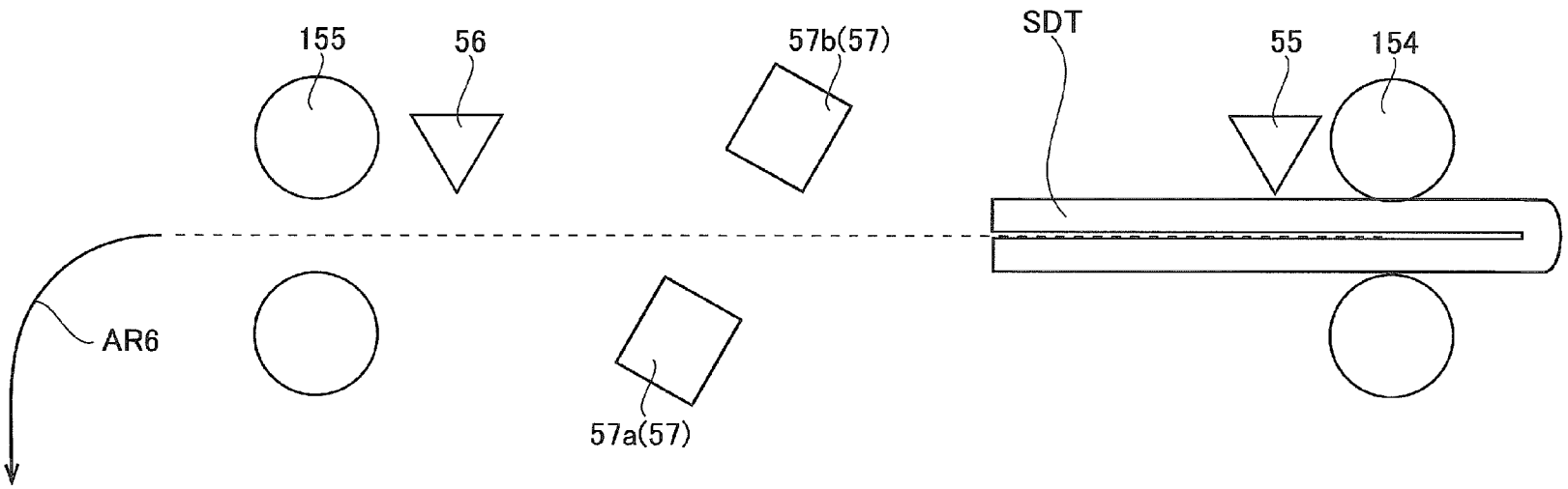
FIGS. 11 and 12 are for explanation pertaining to a correction method for the location of the anterior end of the document and the deviation amount.
Figure 12:
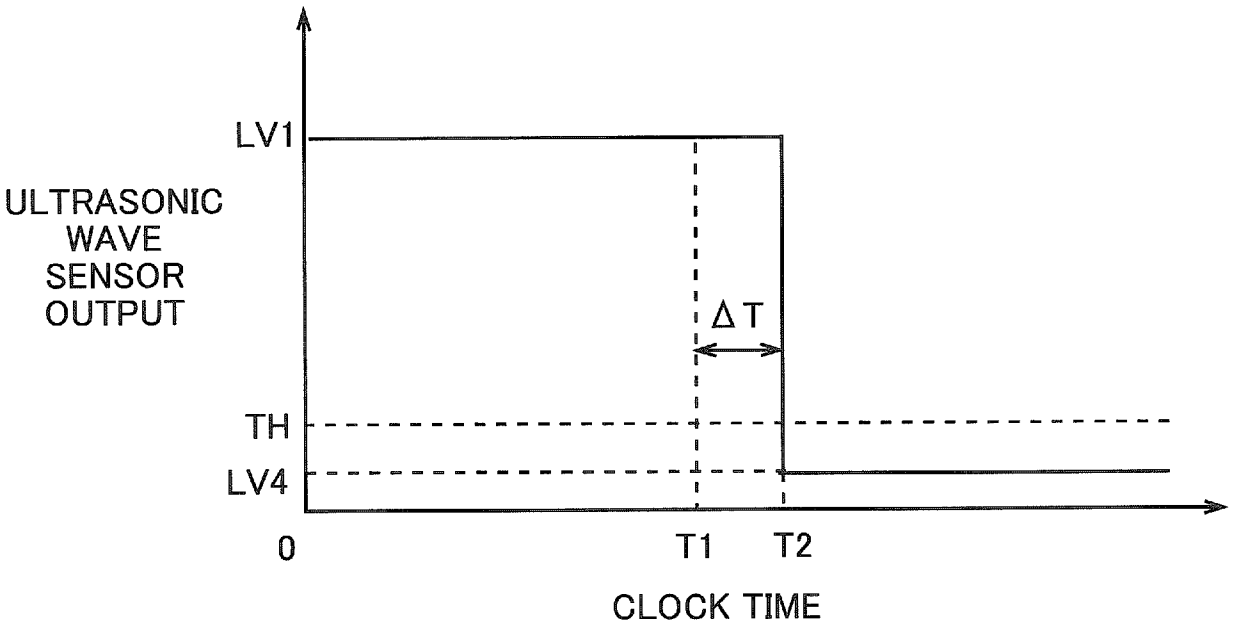

FIGS. 11 and 12 are for explanation pertaining to a correction method for the location of the anterior end of the document and the deviation amount.

Referring to FIG. 11, a user or an administrator of the image forming apparatus sets sample document SDT which is folded lining up the leading ends and consists of two documents, so that the leading ends of the document is at the front and the folded portion is at the back, on document tray 151 (FIG. 3). ADF unit 50 conveys the document. Sample document SDT is for making the image forming apparatus detect the occurrence of multiple feed by design. Sample document SDT is prepared by folding an A3 size sheet with two folds, for example.

Referring to FIG. 12, the electrical voltage value of ultrasonic wave sensor 57 decreases from level LV1 to level LV4 when time T2 has elapsed, wherein time T2 is later than time T1 when the anterior end of document DT1 reaches the detecting location of ultrasonic wave sensor 57. The electrical voltage value of ultrasonic wave sensor 57 becomes less than threshold value TH. This is caused by delay in response, because of characteristics of diffraction of ultrasonic waves. The image forming apparatus detects the occurrence of multiple feed when time T2 has elapsed. A user or an administrator of the image forming apparatus determines the correction amount of the location of the anterior end of the document and the deviation amount, based on the difference between time T2 when the occurrence of multiple feed is detected by ultrasonic wave sensor 57 and time T1 above. The user or the administrator enters the determined correction amount into the image forming apparatus. The image forming apparatus may automatically determine and enter the correction amount by a correction mode or the like, as substitute for the user or the administrator of the image forming apparatus.

[The Control Method of the Upstream Side Roller and the Downstream Side Roller]

The image forming apparatus controls a drive state of upstream side roller 154 and downstream side roller 155, based on the location of the anterior end of the preceding document predicted by the above method and the detection result of multiple feed by ultrasonic wave sensor 57. Control methods of a drive state of upstream side roller 154 and downstream side roller 155 for some situations will be explained in the followings.

In the following explanation, the rotational direction of a roller which feeds a document in the conveying direction may be referred to as a positive direction. The rotational direction of a roller which feeds a document in an opposite direction of the conveying direction may be referred to as a negative direction.

Figure 13:
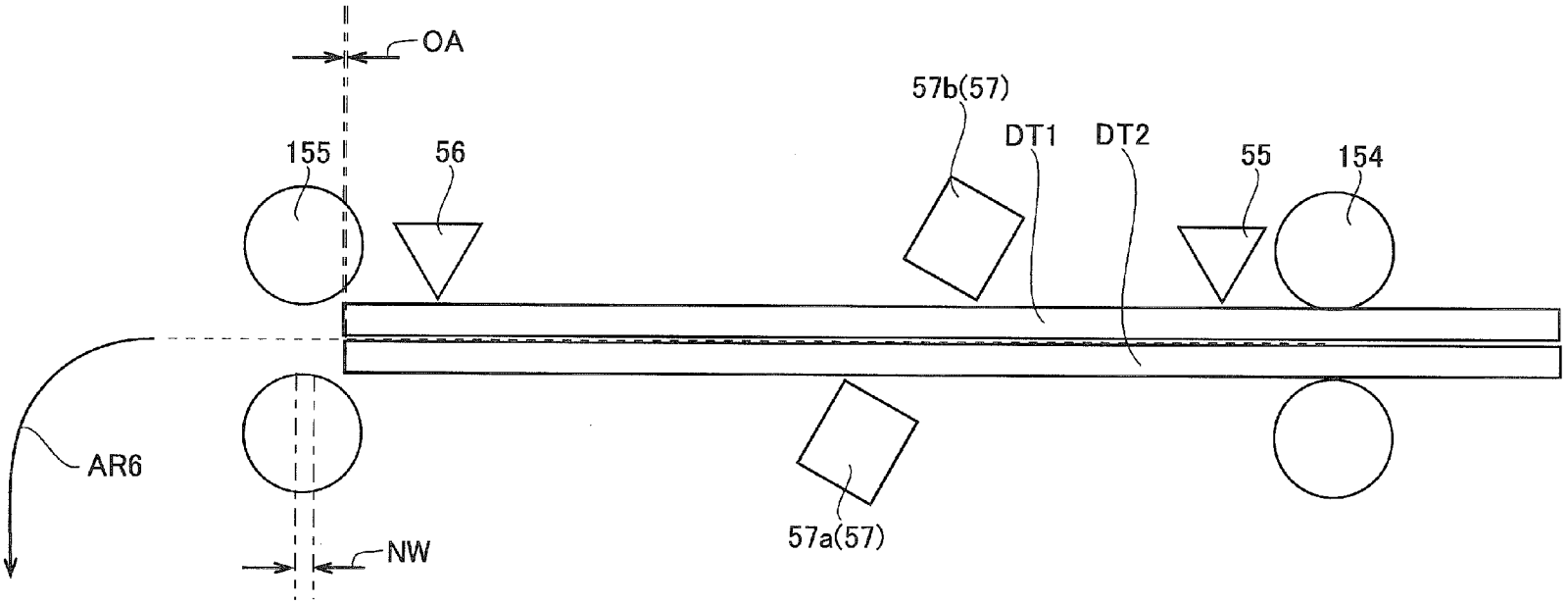
FIG. 13 is for explanation pertaining to a control method of a drive state of upstream side roller 154 and downstream side roller 155 in the first situation.

FIG. 13 is for explanation pertaining to a control method of a drive state of upstream side roller 154 and downstream side roller 155 in the first situation.

Referring to FIG. 13, in the first situation, multiple feed occurs from the location of the anterior end of document DT1. The deviation amount OA is less than nip width NW (an example of a threshold value for the deviation amount) of downstream side roller 155. According to this situation, it is difficult to separate documents DT1 and DT2 being multiple fed by using the roller. In consequence, if the roller keeps on conveying documents DT1 and DT2, there is a risk of an inrush of documents DT1 and DT2 into a downstream side of downstream side roller 155, and a risk of documents DT1 and DT2 being damaged by the nip of downstream side roller 155. It may be caused by mistake of feeding stapled documents DT1 and DT2. Therefore, in the first situation, the image forming apparatus stops the drive of upstream side roller 154 and downstream side roller 155. The image forming apparatus stops the conveying of the documents.

When the image forming apparatus detects the occurrence of multiple feed and stops conveying of the document, the image forming apparatus may give notice of abnormal circumstances of the conveying. The method of notification is arbitrary. For example, a method of displaying the notification on a screen of an operation panel, lighting of a lamp installed on the image forming apparatus, sounding a warning alarm, or the like can be adopted. The notification may preferably urge the user of the image forming apparatus to set the documents again.

Figure 14:
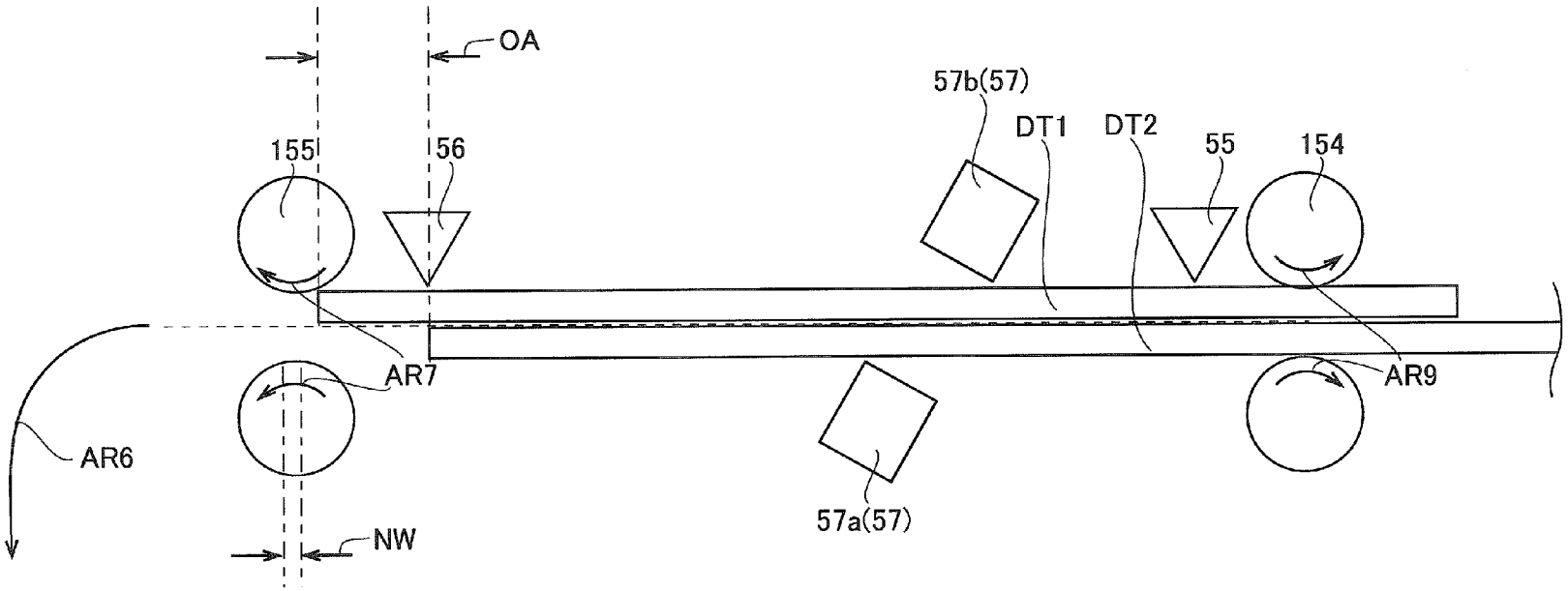
FIG. 14 is for explanation pertaining to a control method of a drive state of upstream side roller 154 and downstream side roller 155 in the second situation.

FIG. 14 is for explanation pertaining to a control method of a drive state of upstream side roller 154 and downstream side roller 155 in the second situation.

Referring to FIG. 14, in the second situation, multiple feed occurred a short distance away from the location of the anterior end of document DT1. The deviation amount OA is larger than a nip width NW of downstream side roller 155. According to this situation, documents DT1 and DT2 being multiple fed can be separated by the roller. Therefore, in the second situation, the image forming apparatus changes a drive state of upstream side roller 154 after the estimated time when the anterior end of document DT1 is expected to reach the nip portion of downstream side roller 155 has elapsed (nipping the leading end of document DT1 by the downstream side roller). Hence, the separate behavior (multiple feed resolving behavior) is performed.

Figure 15:
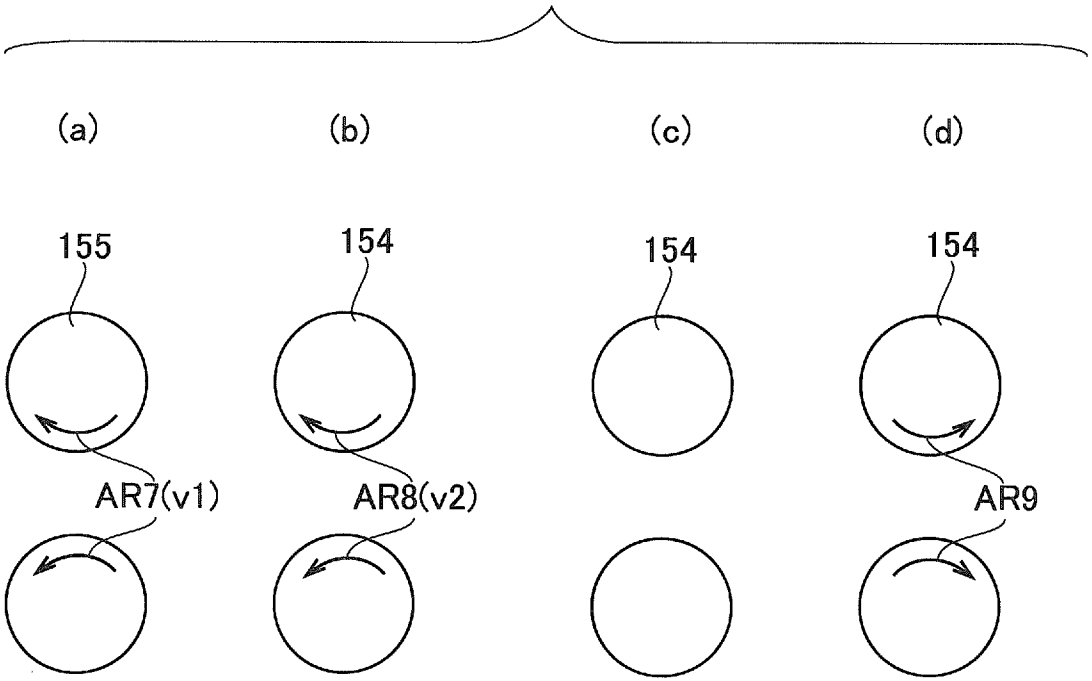
FIG. 15 schematically shows a drive state of upstream side roller 154 and downstream side roller 155 when the image forming apparatus performs separate behavior.

FIG. 15 schematically shows a drive state of upstream side roller 154 and downstream side roller 155 when the image forming apparatus performs separate behavior.

Referring to FIG. 15 (*a*), when the image forming apparatus performs separate behavior, a drive state of downstream side roller 155 is maintained. More specifically, downstream side roller 155 is rotationally driven in a positive direction as shown by arrow AR7 at velocity v1.

On the other hand, when the image forming apparatus performs separate behavior, upstream side roller 154 is rotationally driven so that the relative rotational speed with respect to rotational speed of downstream side roller 155 is a negative value.

More specifically, upstream side roller 154 may be rotationally driven in a positive direction as shown by arrow AR8 of FIG. 15 (*b*), reducing the velocity to v2 which is lower than velocity v1. Upstream side roller 154 may stop the rotation as shown by FIG. 15 (*c*). Upstream side roller 154 may be rotationally driven in a negative direction as shown by arrow AR9 of FIG. 15 (*d*). When the image forming apparatus performs separate behavior, the image forming apparatus may change the drive state of upstream side roller 154 to at least one state of FIG. 15 (*b*), FIG. 15(*c*), and FIG. 15 (*d*).

In the order of FIG. 15 (*d*), FIG. 15 (*c*), and FIG. 15 (*b*), the ability of separation of documents being multiple fed decreases, also the magnitude of damage decreases. When conveying documents, it is often the case that there are not the alternatives. Hence, the damage to the documents caused by the separate behavior is desire to be minimized. Which of the states of FIG. 15 (*b*), FIG. 15 (*c*), and FIG. 15 (*d*) to be adopted is preferably decided, based on the damage to the document, the distance between upstream side roller 154 and downstream side roller 155, the document size and type, the overlapping width, or the like.

Upstream side roller 154A comprises a pair of rollers. The both of the rollers may be rotationally driven, so that the relative rotational speed of the rollers is a negative value with respect to the rotational speed of downstream side roller 155. One of the rollers may be rotationally driven, so that the relative rotational speed of the roller is a negative value with respect to the rotational speed of downstream side roller 155.

In this embodiment, the image forming apparatus rotationally drives upstream side roller 154 in a negative direction as shown by arrow AR9 of FIG. 15 (*d*).

Figure 16:
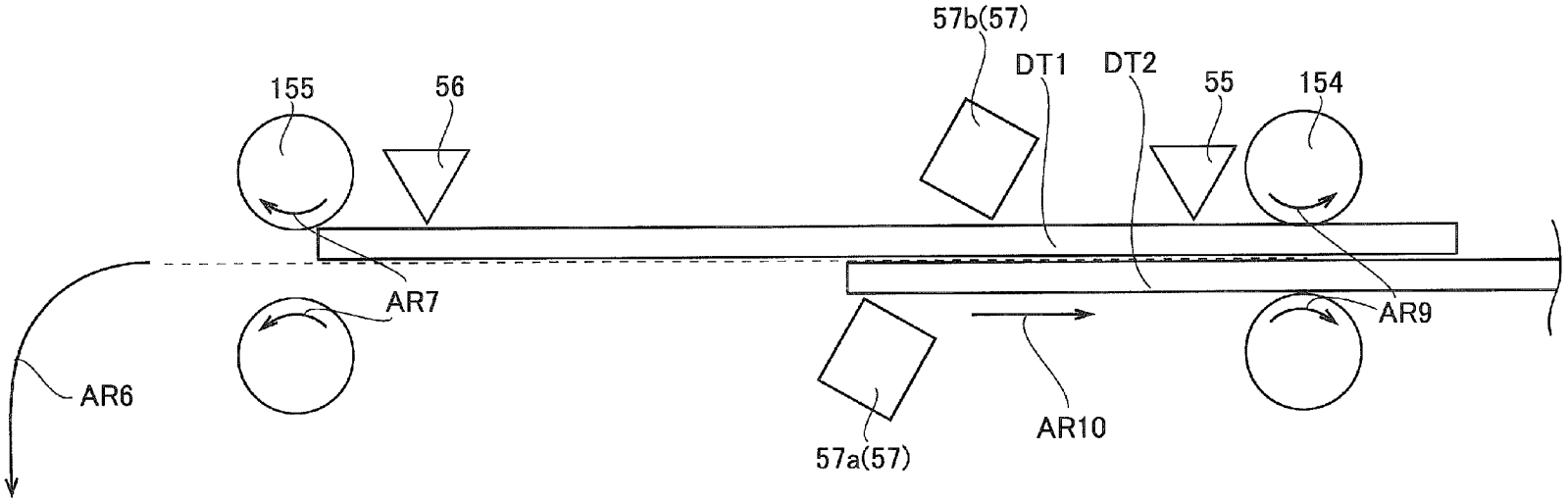
FIG. 16 shows a state in which the multiple feed of documents DT1 and DT2 is being solved by the separate behavior of the image forming apparatus in the second situation.

FIG. 16 shows a state in which the multiple feed of documents DT1 and DT2 is being solved by the separate behavior of the image forming apparatus in the second situation.

Referring to FIG. 16, when downstream side roller 155 and upstream side roller 154 perform separate behavior, the anterior end of document DT1 is nipped by downstream side roller 155. Document DT2 is subject to forces wherein the direction (the direction shown by arrow AR10) is opposite from the direction shown by arrow AR6. The rotary torque of downstream side roller 155 is larger than the rotary torque of upstream side roller 154. In consequence, document DT1 is conveyed in the direction of arrow AR6, and document DT2 is separated from document DT1 in the direction of arrow AR10. Hence, multiple feed is being resolved.

Figure 17:
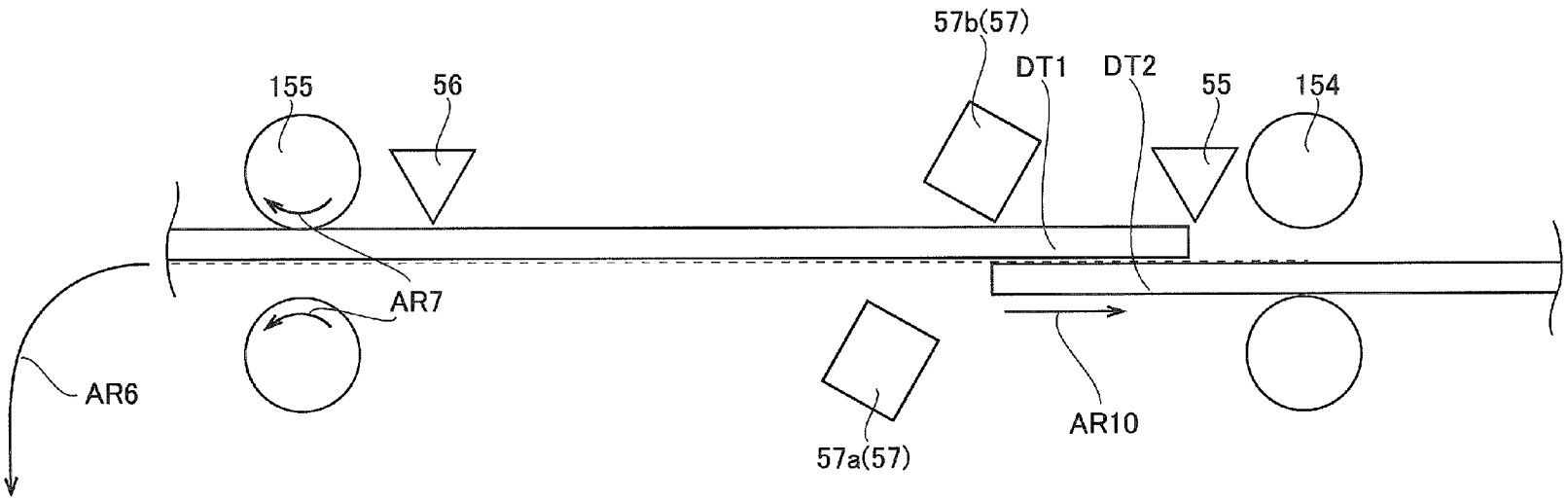
FIG. 17 is for explanation pertaining to a control method of a drive state of upstream side roller 154 and downstream side roller 155 in the third situation.

FIG. 17 is for explanation pertaining to a control method of a drive state of upstream side roller 154 and downstream side roller 155 in the third situation.

Referring to FIG. 17, the third situation shows that after the separate behavior of the image forming apparatus in the second situation, ultrasonic wave sensor 57 does not detect the occurrence of multiple feed at the estimated time when the posterior end of document DT1 is expected to pass the detecting location of upstream side sensor 55 (at the timing when the posterior end of document DT1 passes through upstream side sensor 55). In this situation, documents being multiple fed are favorably being separated (multiple feed is being resolved (the deviation amount is increasing)). According to this situation, the image forming apparatus may continue the separate behavior till the documents being multiple fed are completely separated. However, the image forming apparatus preferably changes the drive state of the upstream side roller at this timing, so that the relative rotational speed (a negative value) of upstream side roller 154 with respect to the rotational speed of downstream side roller 155 approaches zero.

Figure 18:
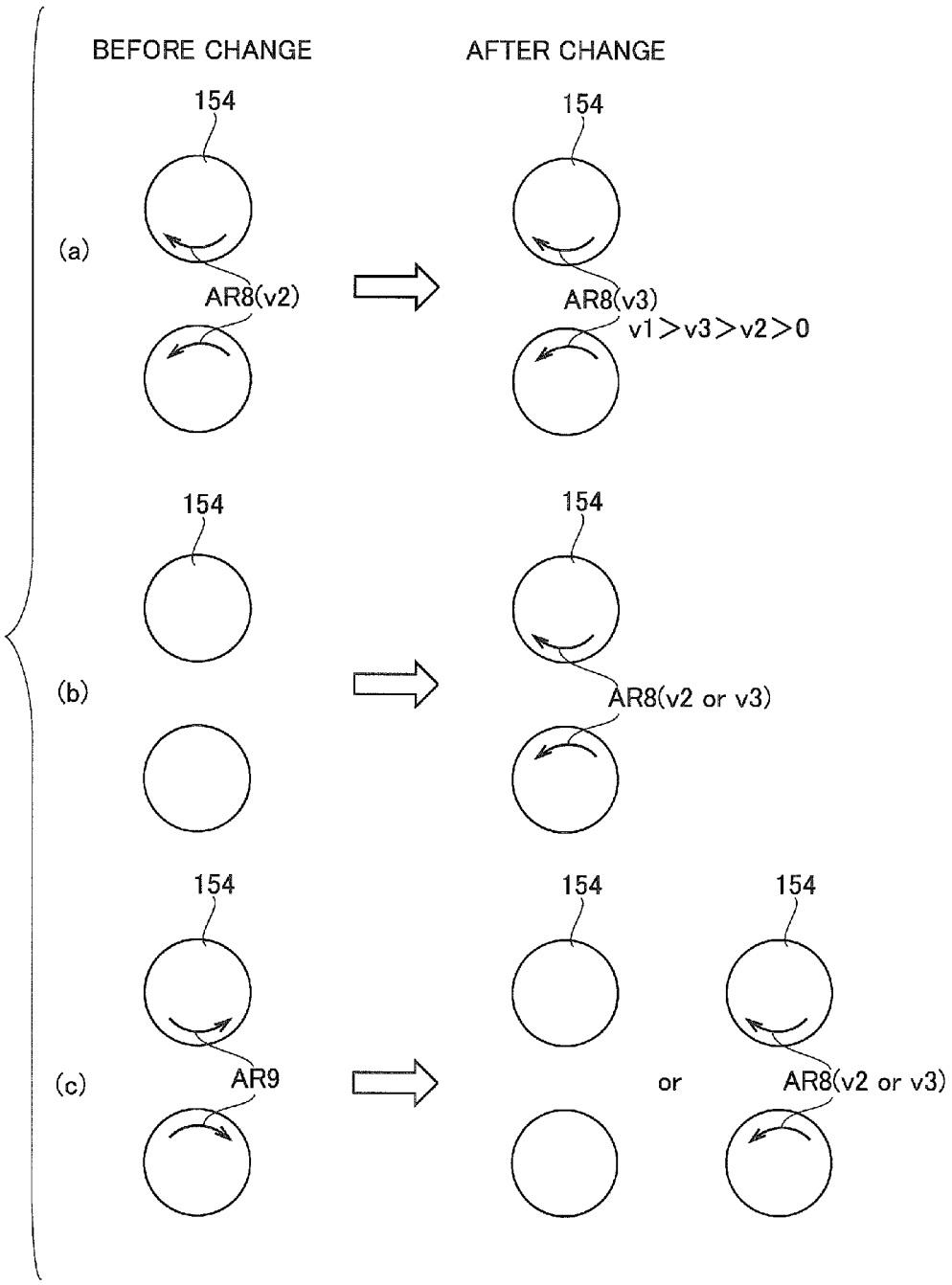
FIG. 18 schematically shows a drive state of upstream side roller 154 when the image forming apparatus changes the drive state of the upstream side roller, so that relative rotational speed of upstream side roller 154 with respect to rotational speed of downstream side roller 155 approaches zero.

FIG. 18 schematically shows a drive state of upstream side roller 154 when the image forming apparatus changes the drive state of the upstream side roller so that relative rotational speed of upstream side roller 154 with respect to rotational speed of downstream side roller 155 approaches zero.

Referring to FIG. 18 (*a*), in case that upstream side roller 154 before the change is rotationally driven in a positive direction (the direction shown by arrow AR8) at velocity v2, upstream side roller 154 may be rotationally driven in the positive direction at velocity v3 which is lower than velocity v1 (the rotational speed of downstream side roller 155) and higher than velocity v2.

Referring to FIG. 18 (*b*), in case that upstream side roller 154 before the change stops, upstream side roller 154 may be rotationally driven in a positive direction (the direction shown by arrow AR8) at velocity v2 or v3.

Referring to FIG. 18 (*c*), in case that upstream side roller 154 before the change is rotationally driven in a negative direction (the direction shown by arrow AR9), upstream side roller 154 may stop or be rotationally driven in a positive direction (the direction shown by arrow AR8) at velocity v2 or v3.

In this embodiment, the image forming apparatus stops rotation of upstream side roller 154.

When the difference between the rotational speed of upstream side roller 154 and the rotational speed of downstream side roller 155 exists, forces to separate the documents being multiple fed (forces in which the direction is shown by arrow AR10 of FIG. 17) continue to exist. Hence, the drive state of the upstream side roller is changed, so that the relative rotational speed of upstream side roller 154 with respect to the rotational speed of downstream side roller 155 approaches zero. Then, the documents being multiple fed are being separated and the damage of the documents caused by upstream side roller 154 can be reduced.

Figure 19:
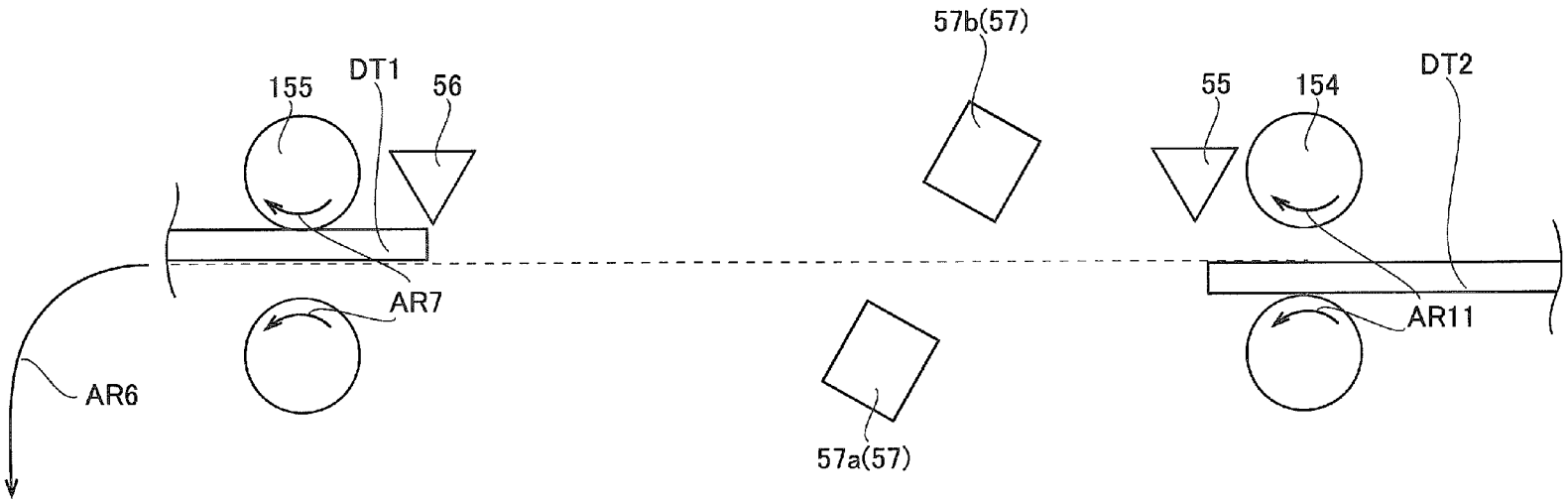
FIG. 19 is for explanation pertaining to a control method of a drive state of upstream side roller 154 and downstream side roller 155 in the fourth situation.

FIG. 19 is for explanation pertaining to a control method of a drive state of upstream side roller 154 and downstream side roller 155 in the fourth situation.

Referring to FIG. 19, the fourth situation shows that after changing a drive state of upstream side roller 154 in the third situation, the image forming apparatus does not detect the document by downstream side sensor 56 at the estimated time when the posterior end of document DT1 is expected to pass the detecting location of downstream side sensor 56 (at the timing when the posterior end of document DT1 passes through downstream side sensor 56). In this situation, the documents being multiple fed have been separated. According to this situation, the image forming apparatus changes a drive state of upstream side roller 154, so that relative rotational speed of upstream side roller 154 with respect to the rotational speed of downstream side roller 155 is reduced to zero. The situation that relative rotational speed of upstream side roller 154 with respect to the rotational speed of downstream side roller 155 is zero shows that the rotational direction and rotational speed of downstream side roller 155 coincide with the rotational direction and rotational speed of upstream side roller 154 as shown by arrows AR7 and AR11. It is the normal rotating situation of upstream side roller 154 when conveying documents. Herewith, the image forming apparatus can continue to convey each of documents DT1 and DT2.

Figure 20:
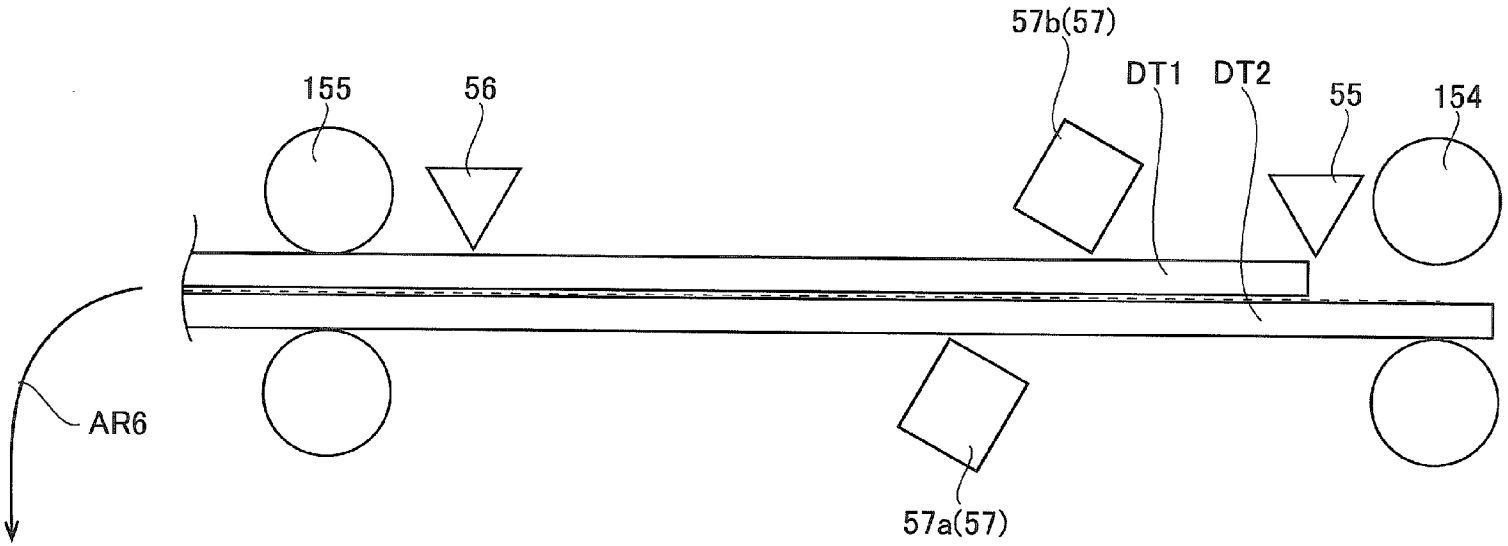
FIG. 20 is for explanation pertaining to a control method of a drive state of upstream side roller 154 and downstream side roller 155 in the fifth situation.

FIG. 20 is for explanation pertaining to a control method of a drive state of upstream side roller 154 and downstream side roller 155 in the fifth situation.

Referring to FIG. 20, the fifth situation shows that after the separate behavior of the image forming apparatus in the second situation, ultrasonic wave sensor 57 detects the occurrence of multiple feed after the estimated time when the posterior end of document DT1 is expected to pass the detecting location of upstream side sensor 55 has elapsed. This situation shows failure in separation of the documents being multiple fed. According to this situation, the image forming apparatus stops driving of upstream side roller 154 and downstream side roller 155, and stops conveying the documents. Herewith, the damage to documents DT1 and DT2 can be reduced. It can also prevent an unscanned document (document DT2) being mixed into scanned documents on copy receiving tray 152.

Figure 21:
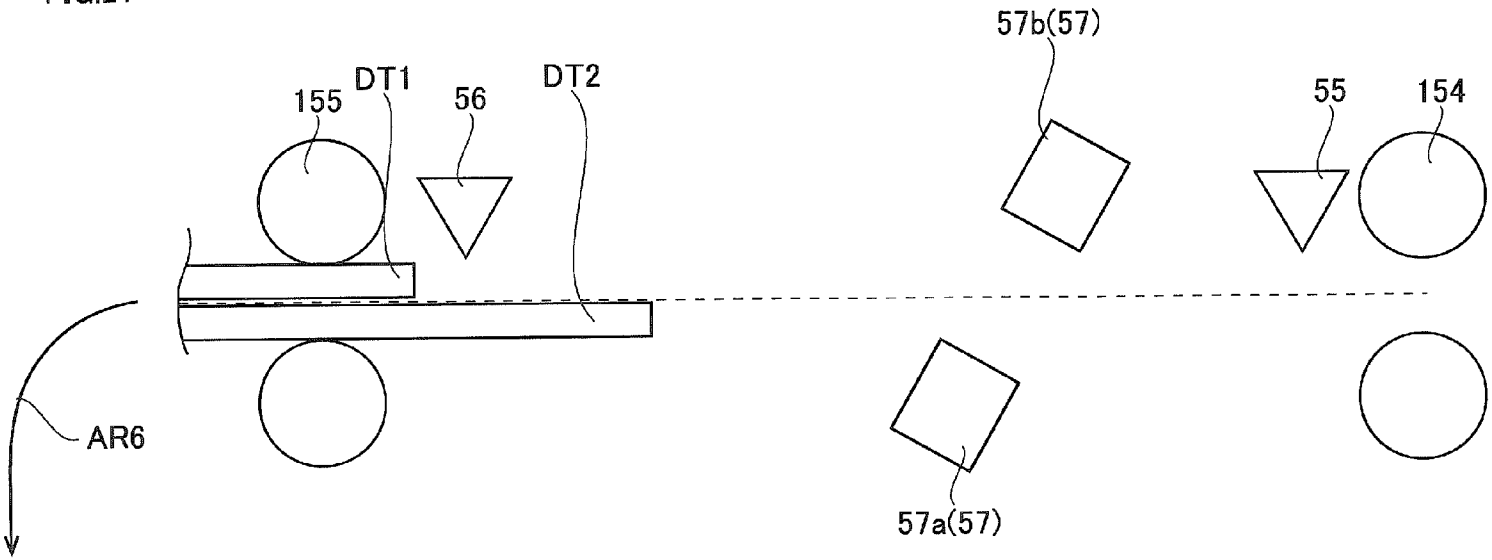
FIG. 21 is for explanation pertaining to a control method of a drive state of upstream side roller 154 and downstream side roller 155 in the sixth situation.

FIG. 21 is for explanation pertaining to a control method of a drive state of upstream side roller 154 and downstream side roller 155 in the sixth situation.

Referring to FIG. 21, the sixth situation shows that after the separate behavior of the image forming apparatus in the second situation, downstream side sensor 56 detects the document after the estimated time when the posterior end of document DT1 is expected to pass through the detecting location of downstream side sensor 56 has elapsed. In this situation, document DT2 is drawn into downstream side sensor 56, and separation of documents being multiple fed is failed. According to this situation, the image forming apparatus stops driving the upstream side roller 154 and downstream side roller 155, and stops conveying the documents. Herewith, damage to documents DT1 and DT2 can be reduced. It can also prevent an unscanned document (document DT2) being mixed into scanned documents on copy receiving tray 152.

Figure 22:
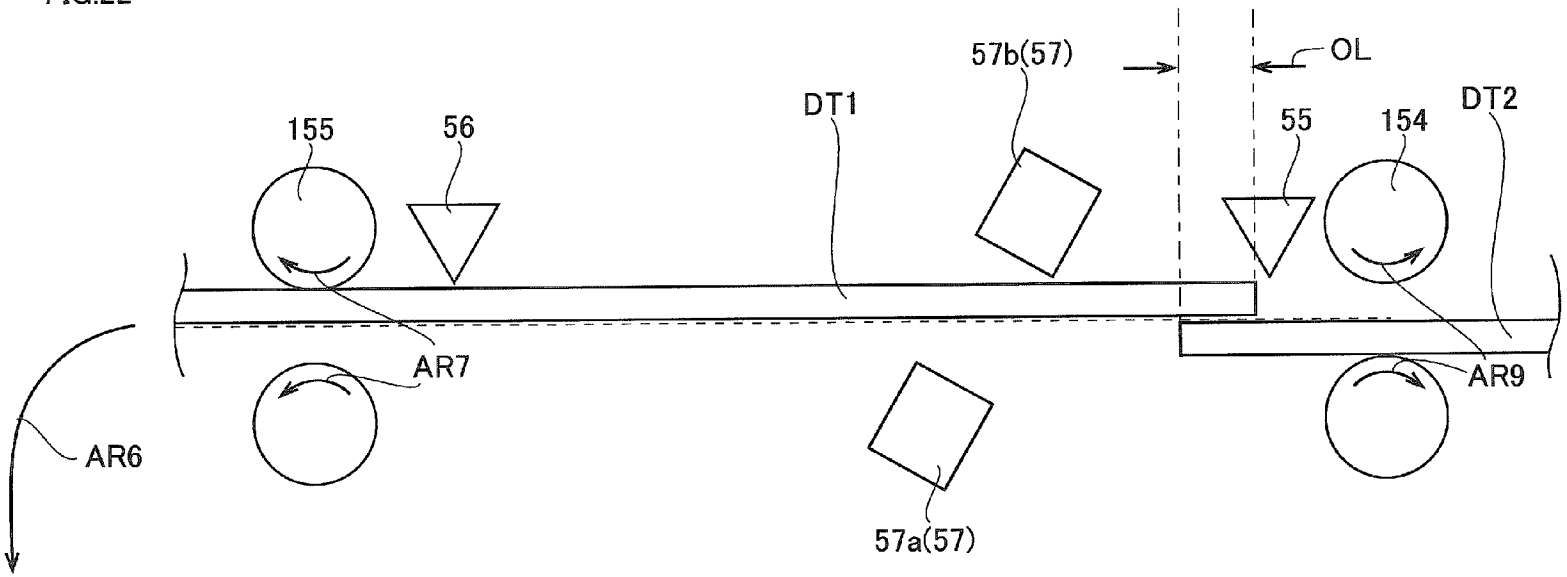
FIG. 22 is for explanation pertaining to a control method of a drive state of upstream side roller 154 and downstream side roller 155 in the seventh situation.

FIG. 22 is for explanation pertaining to a control method of a drive state of upstream side roller 154 and downstream side roller 155 in the seventh situation.

Referring to FIG. 22, the seventh situation shows that ultrasonic wave sensor 57 does not detect the occurrence of multiple feed, and upstream side sensor 55 detects the document after the estimated time when the posterior end of document DT1 is expected to pass through the detecting location of upstream side sensor 55 has elapsed. This situation may happen, in case that the overlapping width of documents being multiple fed is small. According to this situation, the image forming apparatus performs separate behavior by rotationally driving upstream side roller 154, so that the relative rotational speed with respect to the rotational speed of downstream side roller 155 is a negative value.

In this embodiment, the image forming apparatus performs separate behavior by rotationally driving upstream side roller 154 in a negative direction (the direction shown by arrow AR9).

In the seventh situation, the image forming apparatus performs separate behavior. The occurrence of multiple feed in which the overlapping width is too small for ultrasonic wave sensor 57 to detect the occurrence due to characteristics of diffraction of ultrasonic waves, can be detected. The image forming apparatus can start performing separate behavior before the multiple fed portion reaches the detecting location of ultrasonic wave sensor 57. The damage to documents caused by multiple feed can be reduced.

In case that downstream side sensor 56 does not detect the document at the estimated time when the posterior end of document DT1 is expected to pass through the detecting location of downstream side sensor 56 after the image forming apparatus performed the separate behavior, the separation of documents being multiple fed was completed. In this instance, the image forming apparatus changes a drive state of upstream side roller 154 as it is similarly for the behavior in FIG. 19, so that the relative rotational speed of upstream side roller 154 with respect to the rotational speed of downstream side roller 155 is reduced to zero. Herewith, the image forming apparatus can continue to convey each of documents DT1 and DT2.

Figure 23:
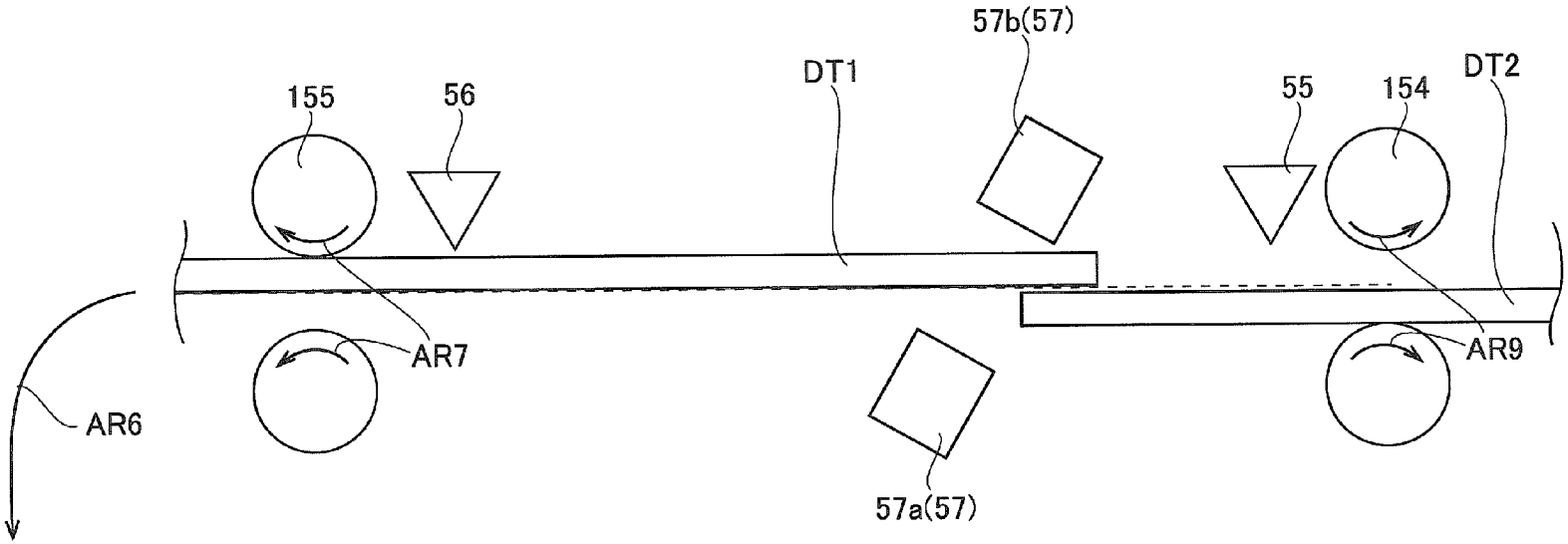
FIG. 23 shows a conveying state of documents when the image forming apparatus in the seventh situation is performing separate behavior.

FIG. 23 shows a conveying state of documents when the image forming apparatus in the seventh situation is performing separate behavior.

Referring to FIG. 23, in case that the overlapping width of the documents is almost equal to the distance between upstream side sensor 55 and ultrasonic wave sensor 57 or the like, documents DT1 and DT2 for which multiple feed is unresolved may pass through the detecting location of ultrasonic wave sensor 57, even though the image forming apparatus is performing the separate behavior. Herewith, ultrasonic wave sensor 57 may detect the occurrence of multiple feed, separately from the occurrence of multiple feed detected based on the detecting state of upstream side sensor 55. In this instance, although upstream side roller 154 has stopped based on the detection of the occurrence of multiple feed by upstream side sensor 55, upstream side roller 154 may be rotated backward etc. based on the detection of the occurrence of multiple feed by ultrasonic wave sensor 57. It may pose a risk of creating confusion for controlling. Therefore, the image forming apparatus preferably controls a drive state of the upstream side roller without the detection result of multiple feed from ultrasonic wave sensor 57 (stops controlling based on a detection signal of ultrasonic wave sensor 57), during the period from when separate behavior of the seventh situation is started to when a drive state of upstream side roller 154 is changed so that the relative rotational speed of upstream side roller 154 with respect to the rotational speed of downstream side roller 155 is reduced to zero.

Figure 24:
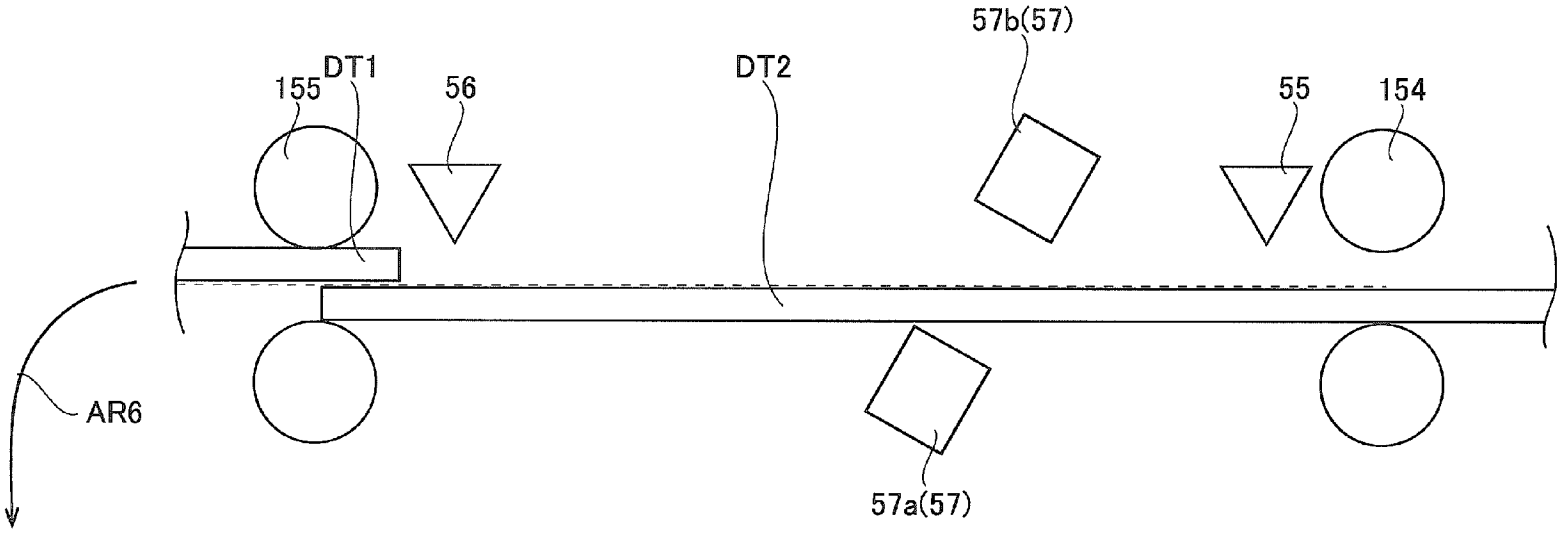
FIG. 24 is for explanation pertaining to a control method of a drive state of upstream side roller 154 and downstream side roller 155 in the eighth situation.

FIG. 24 is for explanation pertaining to a control method of a drive state of upstream side roller 154 and downstream side roller 155 in the eighth situation.

Referring to FIG. 24, the eight situation shows that downstream side sensor 56 detects the document, after the image forming apparatus performed separate behavior in the seventh situation and after the estimated time when the posterior end of document DT1 is expected to pass through the detecting location of downstream side sensor 56 has elapsed. According to this situation, document DT2 is drawn into downstream side sensor 56 and separation of the documents being multiple fed was failed. In this instance, the image forming apparatus stops driving of upstream side roller 154 and downstream side roller 155, and stops conveying the documents. Herewith, damage to documents DT1 and DT2 can be reduced. It can also prevent an unscanned document (document DT2) being mixed into scanned documents on copy receiving tray 152.

Figure 25:
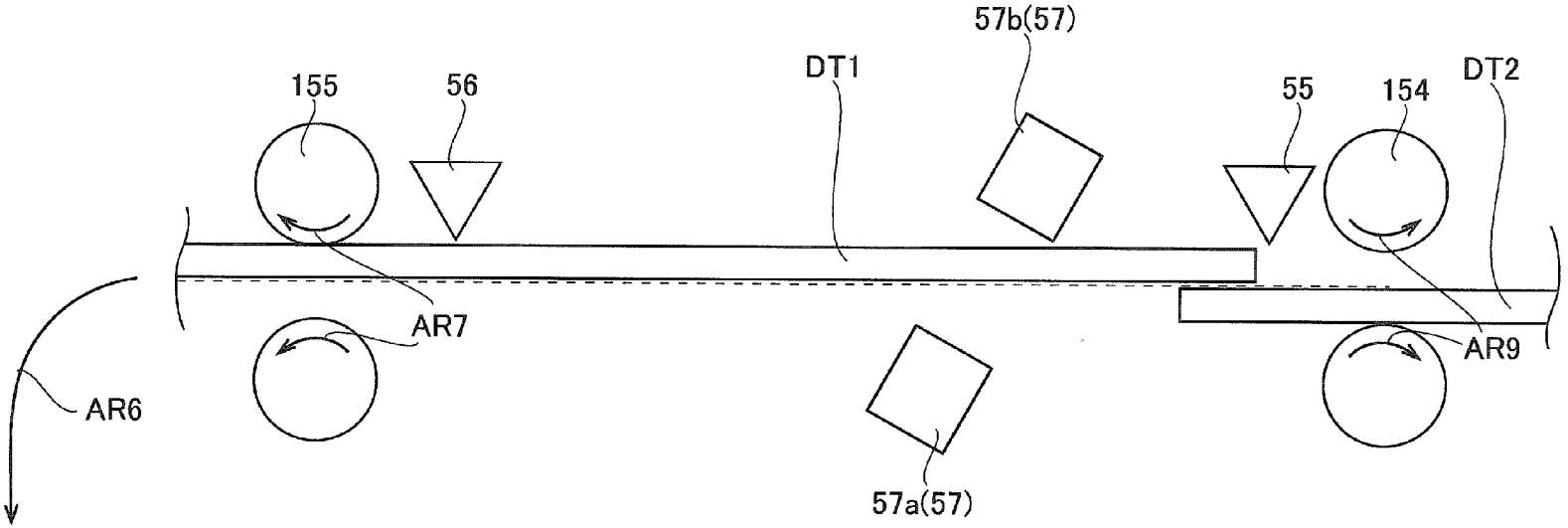
FIG. 25 is for explanation pertaining to a control method of a drive state of upstream side roller 154 and downstream side roller 155 in the ninth situation.

FIG. 25 is for explanation pertaining to a control method of a drive state of upstream side roller 154 and downstream side roller 155 in the ninth situation.

Referring to FIG. 25, the ninth situation shows that upstream side sensor 55 detects the document, at the estimated time when the posterior end of document DT1 is expected to pass through the detecting location of upstream side sensor 55. According to this situation, the image forming apparatus performs separate behavior by changing the drive state of the upstream side roller, so that relative rotational speed of upstream side roller 154 with respect to the rotational speed of downstream side roller 155 is a negative value, regardless of the detection result of multiple feed from ultrasonic wave sensor 57. The image forming apparatus rotationally drives upstream side roller 154 in a negative direction (the direction shown by arrow AR9), for example, to perform separate behavior.

In the ninth situation, the image forming apparatus performs separate behavior regardless of the detection result of ultrasonic wave sensor 57. Hence, the occurrence of multiple feed in which the overlapping width is too small for ultrasonic wave sensor 57 to detect, due to characteristics of diffraction of ultrasonic waves, can be detected. The image forming apparatus can start separate behavior before the portion at which the multiple feed occurred reaches the detecting location of ultrasonic wave sensor 57. Then, the damage of the documents caused by multiple feed can be reduced.

In the ninth situation, in case that downstream side sensor 56 does not detect a document at the estimated time when the posterior end of document DT1 is expected to pass through the detecting location of downstream side sensor 56 after the image forming apparatus performs separate behavior, the separation of documents being multiple fed was completed. In this instance, the image forming apparatus changes the drive state of upstream side roller 154, as similarly the behavior shown in FIG. 19, so that the relative rotational speed of upstream side roller 154 with respect to the rotational speed of downstream side roller 155 is reduced to zero. Herewith, the image forming apparatus can continue to convey each of documents DT1 and DT2.

Figure 26:
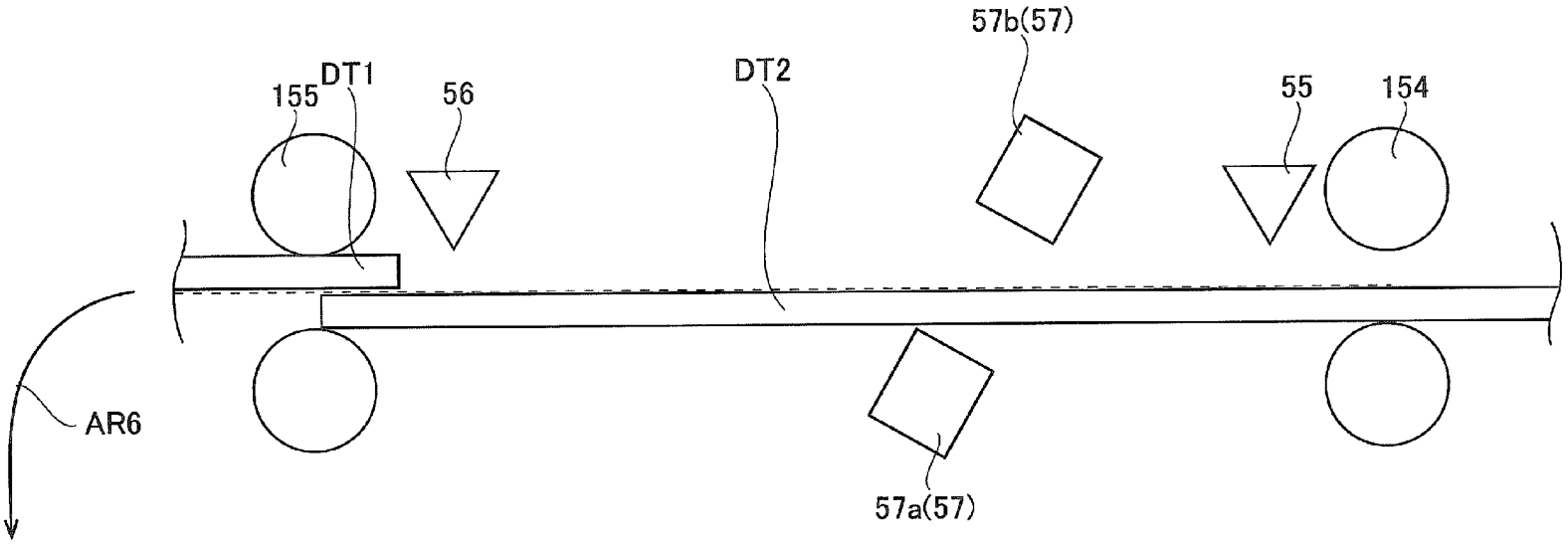
FIG. 26 is for explanation pertaining to a control method of a drive state of upstream side roller 154 and downstream side roller 155 in the tenth situation.

FIG. 26 is for explanation pertaining to a control method of a drive state of upstream side roller 154 and downstream side roller 155 in the tenth situation.

Referring to FIG. 26, the tenth situation shows that downstream side sensor 56 detects a document when the estimated time which the posterior end of document DT1 is expected to pass through the detecting location of downstream side sensor 56, after the image forming apparatus performs separate behavior in the ninth situation. According to this situation, document DT2 is drawn into downstream side sensor 56, and the separation of documents being multiple fed is failed. In this instance, the image forming apparatus stops driving of upstream side roller 154 and downstream side roller 155, and stops conveying the documents. Herewith, the damage to documents DT1 and DT2 can be reduced. It can also prevent an unscanned document (document DT2) being mixed into scanned documents on copy receiving tray 152.

[Flowcharts Which Show Conveying Behavior of the Image Forming Apparatus]

Figure 27:
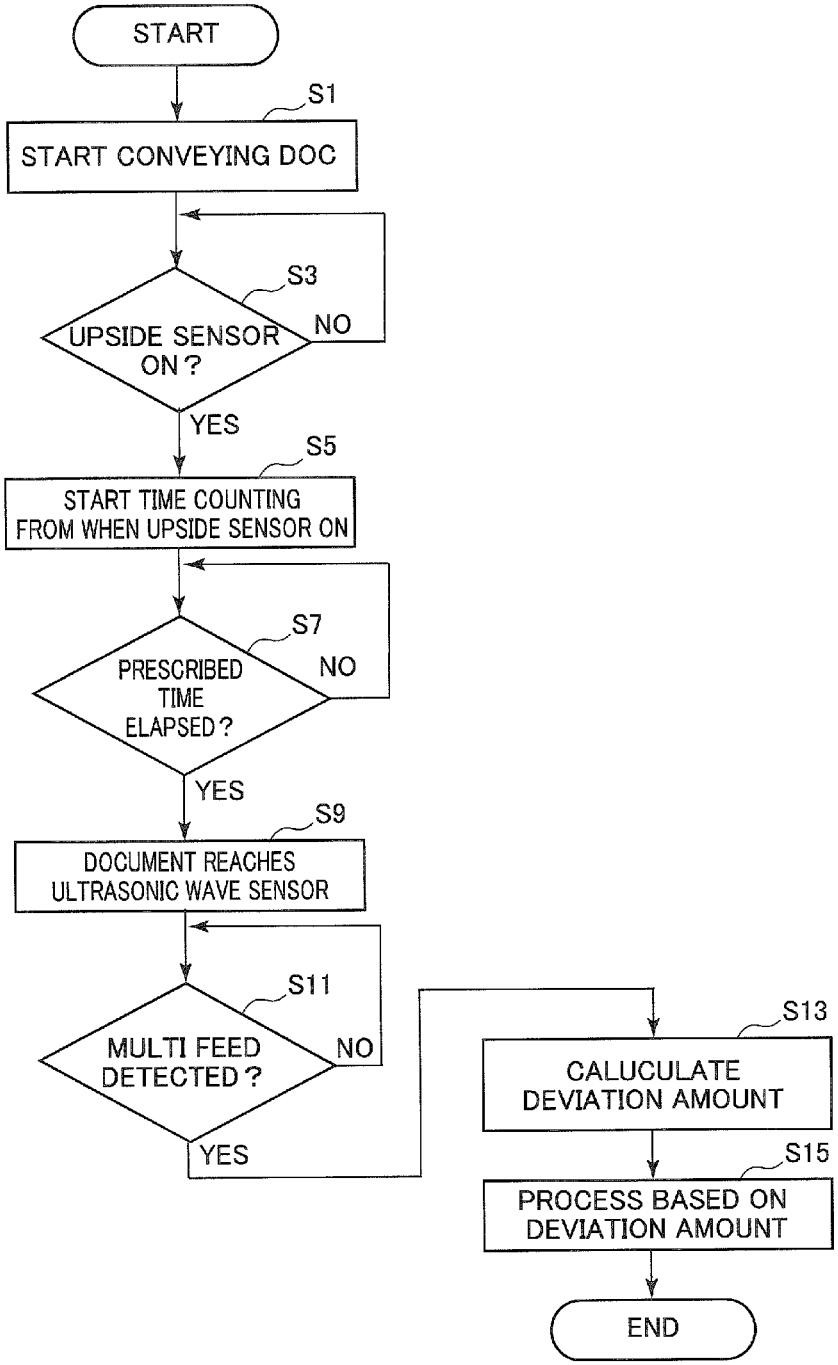
FIG. 27 shows a flowchart of the first conveying behavior of the image forming apparatus in the embodiment of this invention.

FIG. 27 shows a flowchart of the first conveying behavior of the image forming apparatus in the embodiment of this invention.

Referring to FIG. 27, the CPU of the image forming apparatus starts conveying the documents (S1), and determines whether the upstream side sensor is turned on or not (S3). Until the upstream side sensor is turned on, the CPU continues the process of step S3.

When the upstream side sensor is turned on (YES at S3), the CPU begins to count the time, with the clock time when the upstream side sensor is turned on as the starting time (S5). Next, the CPU determines whether the time which the document is expected to reach the detecting location of the ultrasonic wave sensor has elapsed or not (S7). Until the time which the document is expected to reach the detecting location of the ultrasonic wave sensor has elapsed, the CPU continues the process of step S7.

When the time which the document is expected to reach the detecting location of the ultrasonic wave sensor has elapsed (YES at S7), the CPU determines that the anterior end of the document reached the detecting location of the ultrasonic wave sensor (S9). Next, the CPU determines whether the ultrasonic wave sensor detects the occurrence of multiple feed or not (S11). Until the ultrasonic wave sensor detects the occurrence of multiple feed, the CPU continues the process of step S11.

When the ultrasonic wave sensor detects the occurrence of multiple feed (YES at S11), the CPU calculates the deviation amount based on the time elapsed from the estimated time when the document is expected to reach the detecting location of the ultrasonic wave sensor (S13). The CPU performs processes corresponding to the deviation amount (S15), and terminates the processes.

Figure 28:
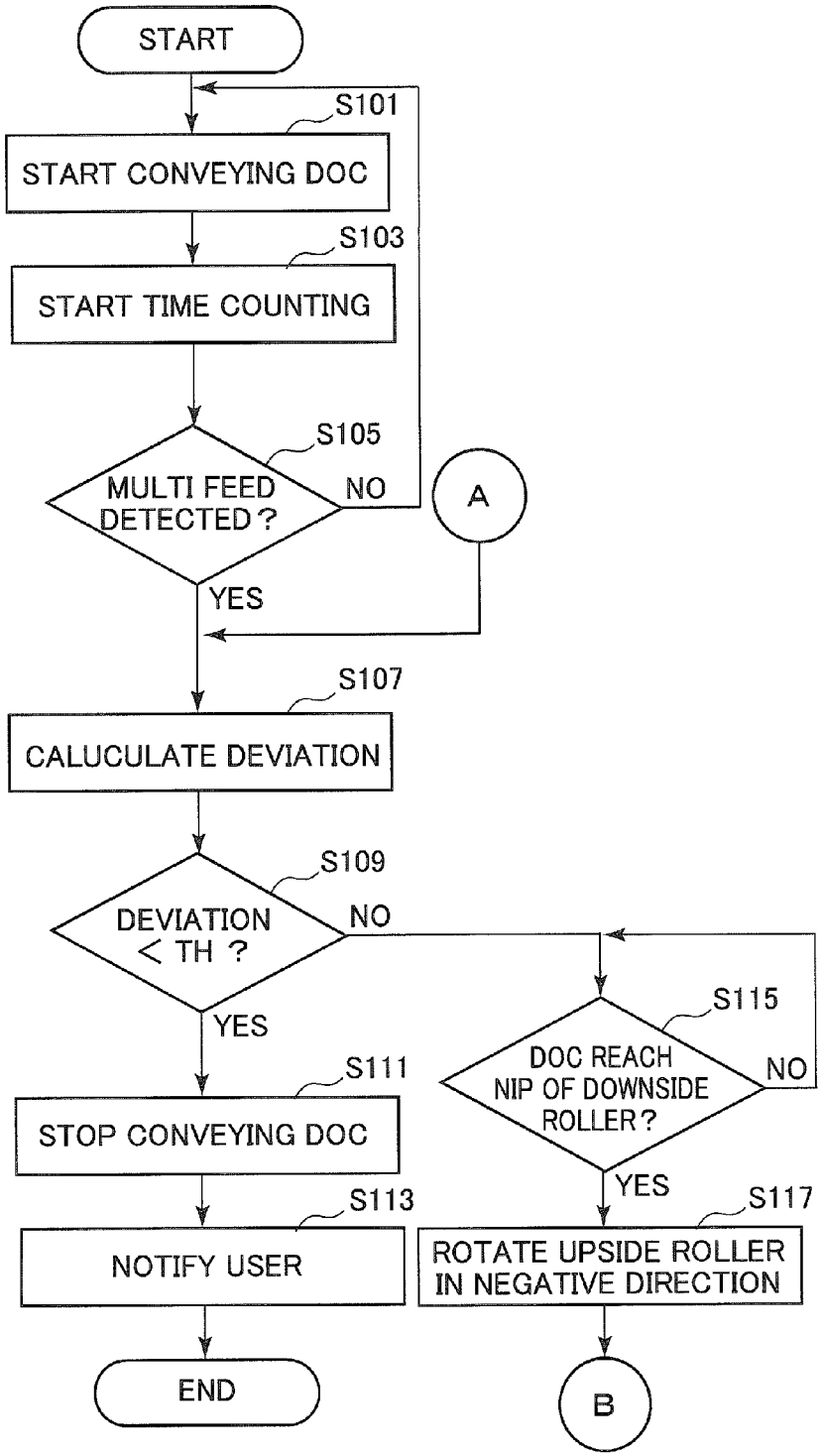
FIGS. 28 and 29 show a flowchart of the second conveying behavior of the image forming apparatus in the embodiment of this invention.
Figure 29:
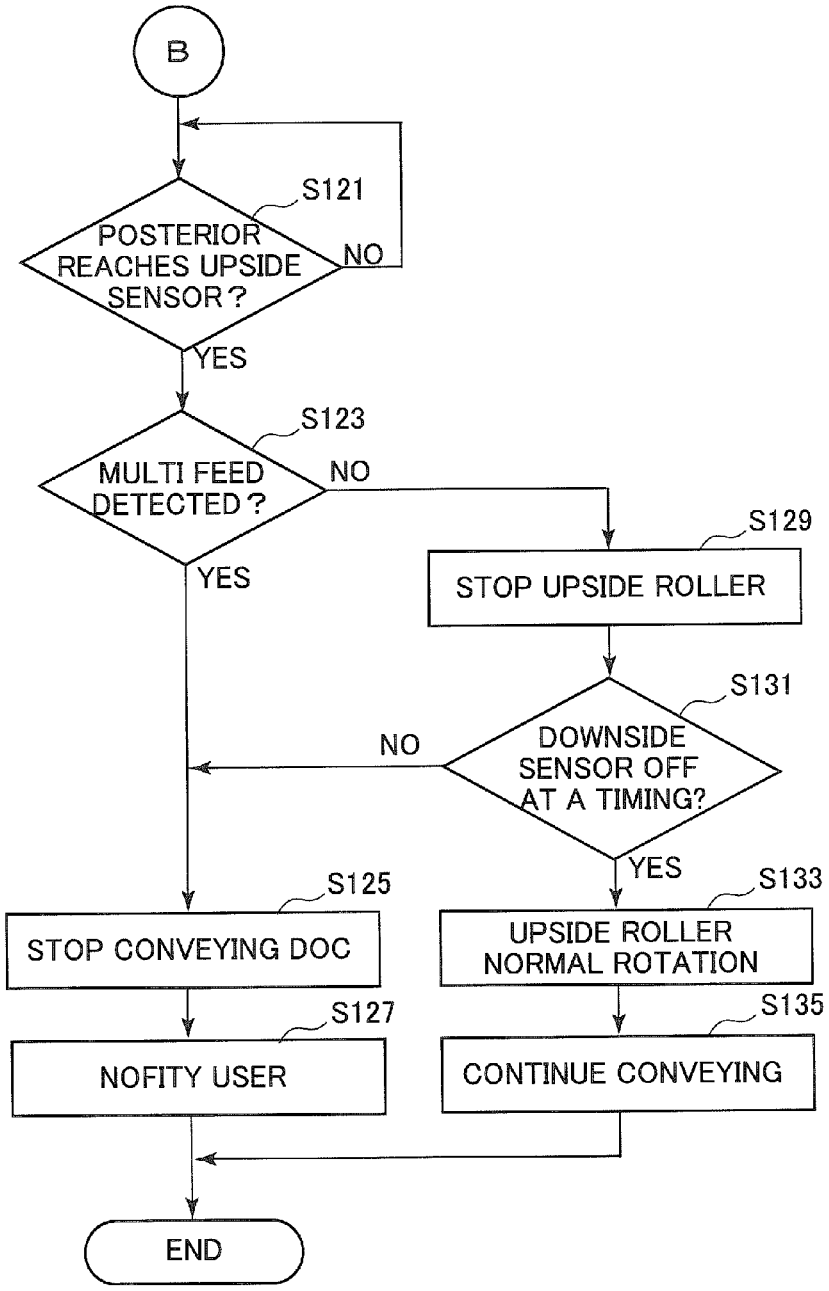

FIGS. 28 and 29 show a flowchart of the second conveying behavior of the image forming apparatus in the embodiment of this invention.

Referring to FIG. 28, the CPU begins to convey the documents (S101). When the CPU detects the anterior end of document at the upstream side sensor, the CPU starts counting the time to predict the location of the documents (S103). The CPU determines whether the ultrasonic wave sensor detects the occurrence of multiple feed or not (S105).

When the occurrence of multiple feed is not detected (NO at S105), the CPU proceeds to the process of step S101, and begins to convey the next document.

When the occurrence of multiple feed is detected (YES at S105), the CPU calculates the deviation amount of the documents being multiple fed (S107). The CPU determines whether the calculated deviation amount is less than the threshold value of the deviation amount or not (S109).

When the calculated deviation amount is less than the threshold value of the deviation amount (YES at S109), the documents being multiple fed cannot be separated by using rollers. In this instance, the CPU stops conveying the documents (S111), informs the user of the occurrence of abnormal circumstances (S113), and terminates the process.

When the calculated deviation amount is equal to or more than the threshold value of the deviation amount (NO at S109), there is the potential for separating documents being multiple fed by using rollers. In this instance, the CPU determines whether the estimated time when the anterior end of document is expected to reach a nip portion of the downstream side roller has elapsed or not (S115). Until the CPU determines that the estimated time when the anterior end of document is expected to reach a nip portion of the downstream side roller has elapsed, the CPU continues the process of step S115.

When the estimated time which the anterior end of document is expected to reach a nip portion of the downstream side roller has elapsed (YES at S115), the CPU rotates the upstream side roller in a negative direction (S117), and steps in the process of step S121 in FIG. 29.

Referring to FIG. 29, at step S121, the CPU determines whether the time when the posterior end of the document is expected to pass through the detecting location of the upstream side sensor has come or not (S121). The determination of step S121 may be carried out based on the predicted location of the posterior end of the document by using the above expression (3), or based on whether the upstream side sensor is turned off or not. Until the time when the posterior end of the document passes through the detecting location of the upstream side sensor has come, the CPU continues the process of step S121.

At step S121, the time when the posterior end of the document passes through the detecting location of the upstream side sensor has come (YES at S121), the CPU determines whether the ultrasonic wave sensor detects the occurrence of multiple feed or not (S123).

When the ultrasonic wave sensor detects the occurrence of multiple feed (YES at S123), the separation of the documents being multiple fed is failed. In this instance, the CPU stops conveying the documents (S125), informs a user of the occurrence of abnormal circumstances (S127), and terminates the process.

When the ultrasonic wave sensor does not detect the occurrence of multiple feed (NO at S123), multiple feed is being resolved by the separate behavior (the deviation amount is increasing). In this instance, the CPU stops rotating the upstream side roller in a negative direction (S129). Next, the CPU determines whether the downstream side sensor is turned off or not, at the timing which the posterior end of the document is expected to passe through the downstream side sensor (S131).

When the downstream side sensor is turned off at the timing which the posterior end of the document is expected to pass through the downstream side sensor (YES at S131), the separation of the documents being multiple fed was completed. In this instance, the CPU gets the upstream side roller back to the normal rotation state (S133), continues to convey the documents (S135), and terminates the process.

When the downstream side sensor is not turned off at the timing which the posterior end of the document is expected to pass through the downstream side sensor (NO at S131), the separation of documents being multiple fed is failed. In this instance, the CPU proceeds to the process of step S125, and stops conveying the documents (S125).

Figure 30:
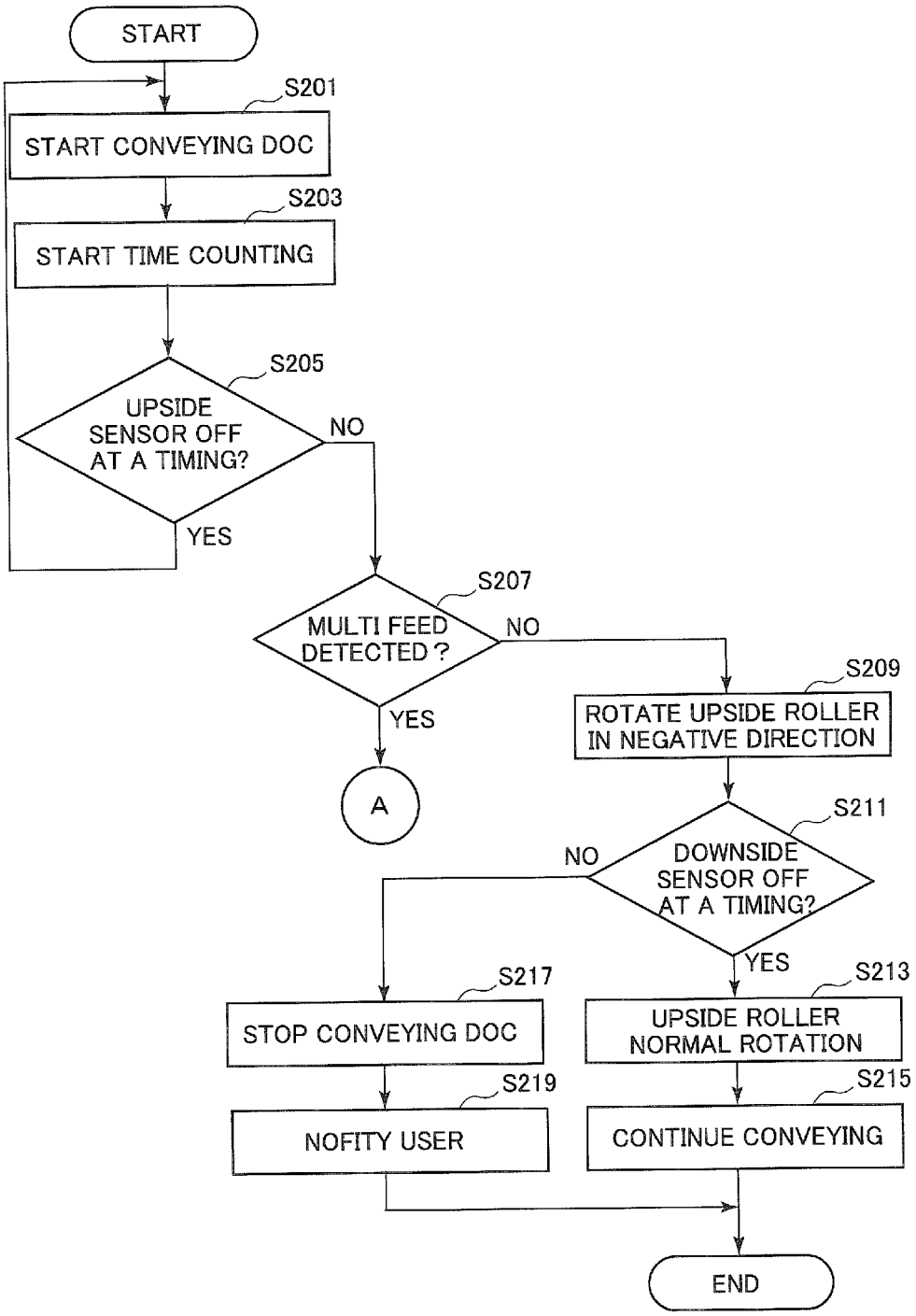
FIG. 30 shows a flowchart of the third conveying behavior of the image forming apparatus in the embodiment of this invention.

FIG. 30 shows a flowchart of the third conveying behavior of the image forming apparatus in the embodiment of this invention.

Referring to FIG. 30, the CPU begins to convey the documents (S201). The CPU starts counting the time for prediction of the location of the document, when the upstream side sensor detects the anterior end of the document (S203). The CPU determines whether the upstream side sensor is turned off or not at the timing which the posterior end of the document is expected to pass through the upstream side sensor (S205).

When the upstream side sensor is turned off at the timing which the posterior end of the document is expected to pass through the upstream side sensor (YES at S205), the CPU determines that multiple feed does not occur. The CPU proceeds to the process of step S201, and begins to convey the next document.

When the upstream side sensor is not turned off at the timing which the posterior end of the document is expected to pass through the upstream side sensor (NO at S205), the CPU determines whether the ultrasonic wave sensor detects the occurrence of multiple feed or not (S207).

When the ultrasonic wave sensor detects the occurrence of multiple feed (YES at S207), the CPU steps in the process of step S107 in FIG. 28.

When the ultrasonic wave sensor does not detect the occurrence of multiple feed (NO at S207), the CPU determines that multiple feed occurred, even though the ultrasonic wave sensor does not detect the occurrence of multiple feed, and performs separate behavior. In this instance, the CPU rotates the upstream side roller in a negative direction (S209). After starting the separate behavior, the CPU does not execute processes based on the detection result of the ultrasonic wave sensor, until the rotation of the upstream side roller is got back to the normal rotation. Next, the CPU determines whether the downstream side sensor is turned off or not at the timing which the posterior end of the document is expected to pass through the downstream side sensor (S211).

When the downstream side sensor is turned off at the timing which the posterior end of the document is expected to pass through the downstream side sensor (YES at S211), the separation of the documents being multiple fed was completed. In this instance, the CPU gets the upstream side roller back to the normal rotation (S213), continues to convey the documents (S215), and terminates the process.

When the downstream side sensor is not turned off at the timing which the posterior end of the document is expected to pass through the downstream side sensor (NO at S211), the separation of the documents being multiple fed is failed. In this instance, the CPU stops conveying the document (S217), informs the user of the occurrence of abnormal circumstances (S219), and terminates the process.

Figure 31:
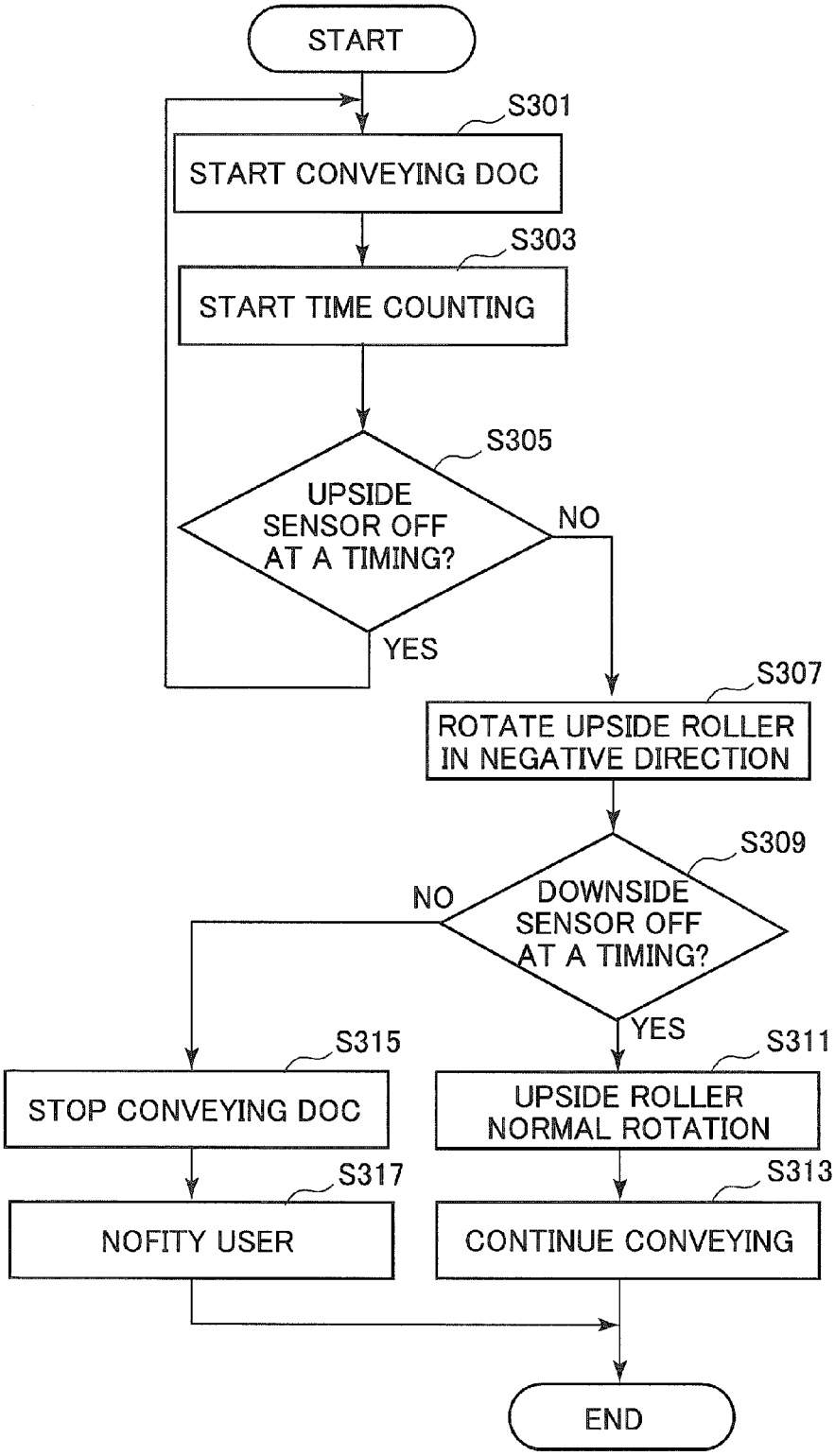
FIG. 31 shows a flowchart of the fourth conveying behavior of the image forming apparatus in the embodiment of this invention.
Figure 32:
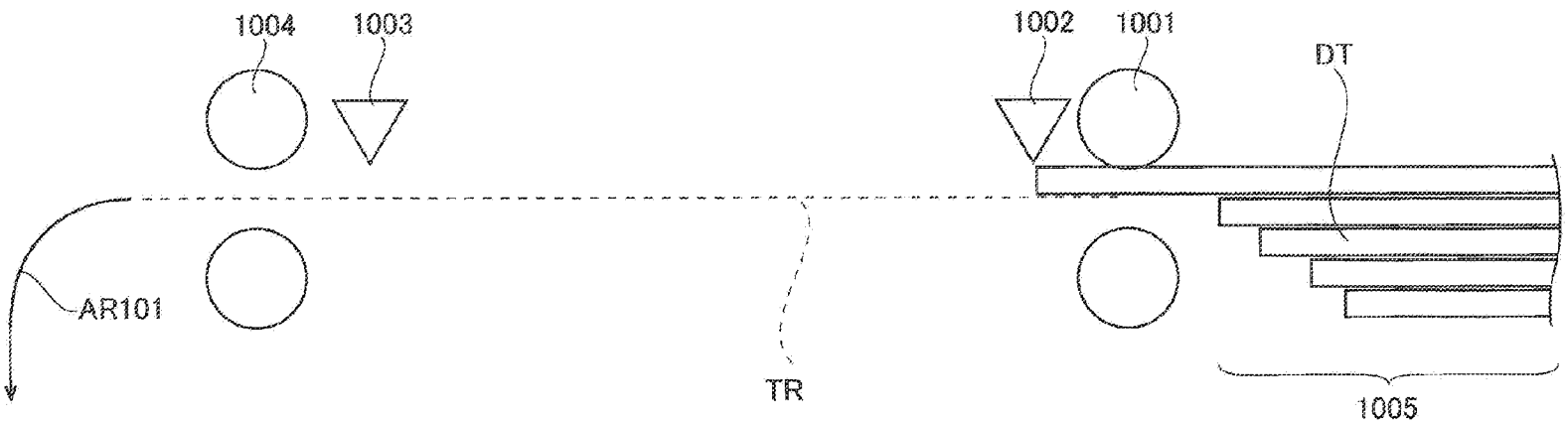
Prior Art FIG.32
FIG. 32 shows a conventional technique using a detection sensor for detecting sheets passing through a conveying path.
Figure 33:
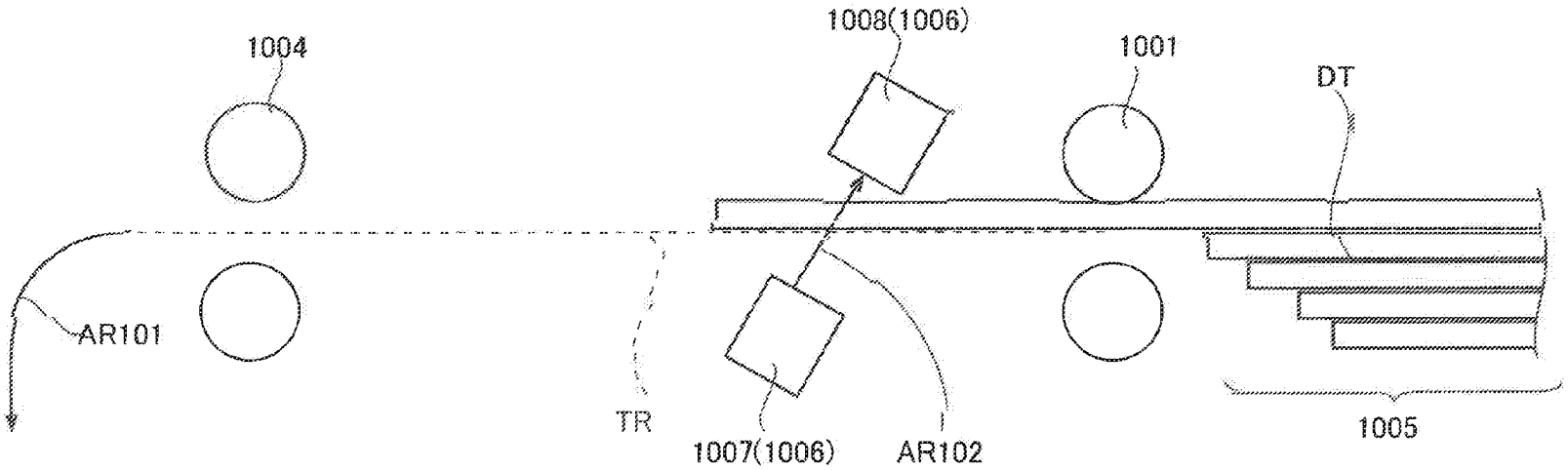
FIG.33 Prior Art
FIG. 33 shows a conventional technique using an ultrasonic wave sensor.
Figure 34:
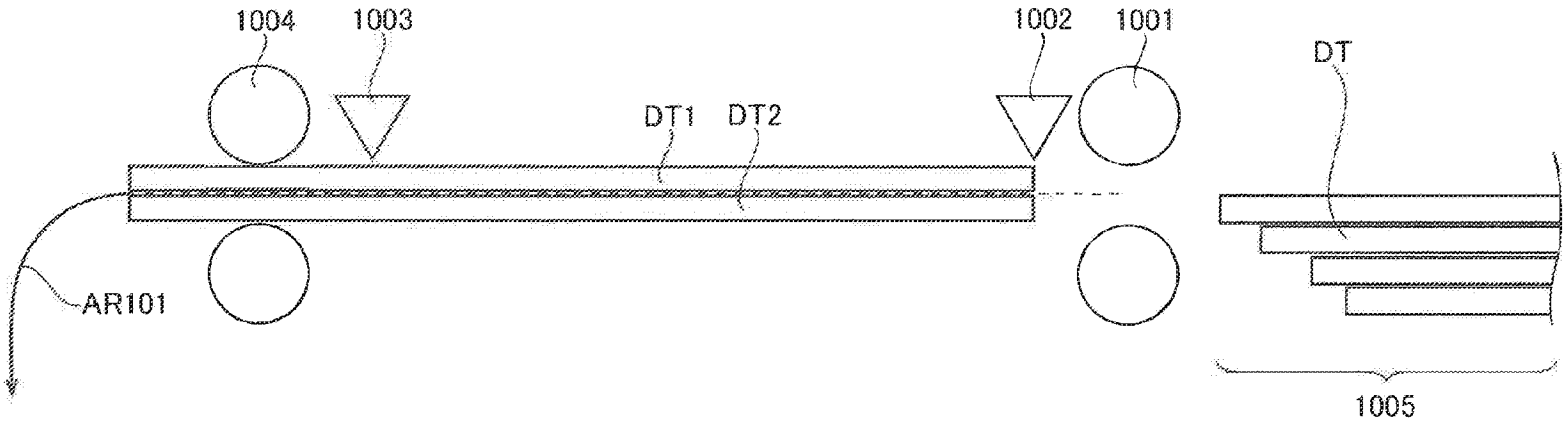
FIG.34 Prior Art
FIGS. 34 and 35 are for explanation pertaining to problems in a conventional technique having a detection sensor for detecting sheets passing through a conveying path.
Figure 35:
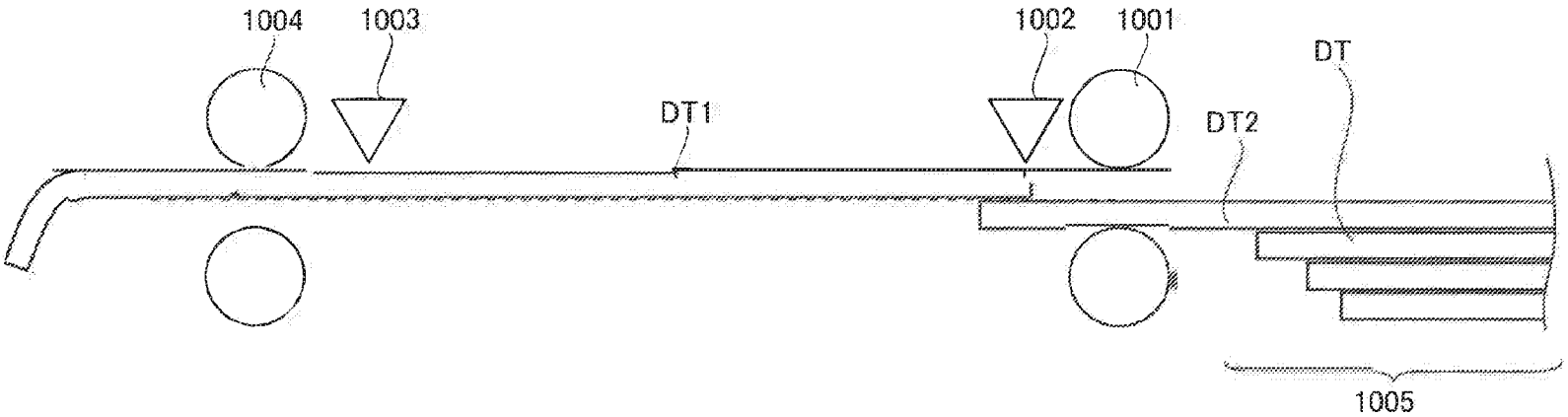
Prior Art FIG.35
Figure 36:
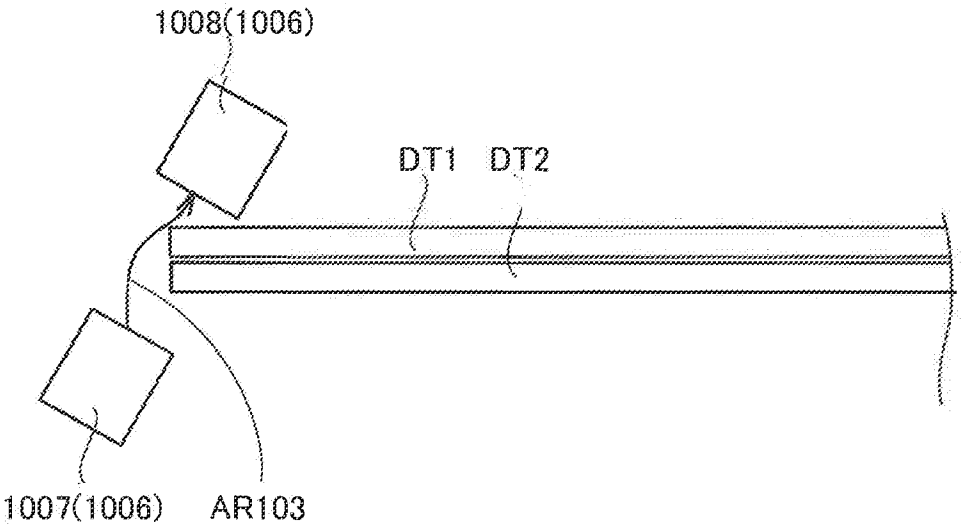
FIG.36 Prior Art
FIGS. 36 and 37 are for explanation pertaining to problems in a conventional technique using an ultrasonic wave sensor.
Figure 37:
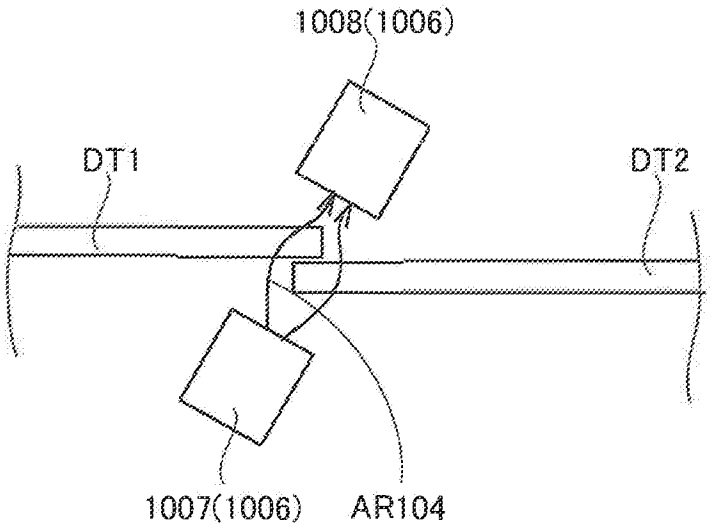
FIG.37 Prior Art

FIG. 31 shows a flowchart of the fourth conveying behavior of the image forming apparatus in the embodiment of this invention.

Referring to FIG. 31, the CPU begins to convey the document (S301). When the upstream side sensor detects the anterior end of the document, the CPU starts counting the time for predicting the location of the document (S303). The CPU determines whether the upstream side sensor is turned off or not, at the timing which the posterior end of the document is expected to pass through the upstream side sensor (S305).

When the upstream side sensor is turned off at the timing which the posterior end of the document is expected to pass through the upstream side sensor (YES at S305), the CPU determines that multiple feed does not occur. The CPU proceeds to the process of step S301, and begins to convey the next document.

When the upstream side sensor is not turned off at the timing which the posterior end of the document is expected to pass through the upstream side sensor (NO at S305), the CPU determines that multiple feed occurred, regardless of whether the ultrasonic wave sensor detects the occurrence of multiple feed or not, and performs separate behavior. In this instance, the CPU rotates the upstream side roller in a negative direction (S307). Next, the CPU determines whether the downstream side sensor is turned off or not, at the timing which the posterior end of the document is expected to pass through the downstream side sensor (S309).

When the downstream side sensor is turned off, at the timing which the posterior end of the document is expected to pass through the downstream side sensor (YES at S309), the separation of the documents being multiple fed was completed. In this instance, the CPU gets the upstream side roller back to the normal rotation (S311), continues to convey the documents (S313), and terminates the process.

When the downstream side sensor is not turned off, at the timing which the posterior end of the document is expected to pass through the downstream side sensor (NO at S309), the separation of the documents being multiple fed is failed. In this instance, the CPU stops conveying the documents (S315), informs the user of the occurrence of abnormal circumstances (S317), and terminates the process.

The Effect of the Embodiment

According to the above embodiments, both the upstream side sensor for detecting the presence or absence of the document being conveyed along the conveying path, and the ultrasonic wave sensor for detecting the presence or absence of the occurrence of multiple feed based on the intensity of the ultrasonic waves received, are used. Therefore, a conveying state of documents can be recognized with more precision. The occurrence of multiple feed can be detected quickly.

The location of the document is calculated based on the time elapsed from detection of the anterior end of the document at the upstream side sensor. The detection accuracy of the location of the anterior end of the document, and the deviation amount of the documents being multiple fed can be improved.

The location of the document is predicted based on the time elapsed from detection of the document at the upstream side sensor. The drive state of the upstream side roller and the downstream side roller is controlled, based on the predicted location of the document and the detection result of multiple feed of the ultrasonic wave sensor. Each of the upstream side roller and the downstream side roller can be suitably driven, in response to the state of the documents (especially, the state of the documents being multiple fed). Others The image forming apparatus may control a drive state of only the upstream side roller based on the predicted location of a sheet and the detection result of multiple feed by the ultrasonic wave sensor. In this instance, the downstream side roller may be rotationally driven in a positive direction at a constant velocity, at all times.

In the above embodiment, documents being conveyed are to be read by a scanner unit. Sheet conveying apparatus may convey sheets which are stored in a paper storage and are to be conveyed to the image forming unit (sheets on which images are to be printed).

The image forming apparatus may execute flowcharts of the first to the fourth conveying behavior above in parallel. The image forming apparatus may execute the one of flowcharts of the first to the fourth conveying behavior above.

According to this invention, a sheet conveying apparatus, a control method of a sheet conveying apparatus, and a control program of a sheet conveying apparatus being able to recognize a state of sheet conveying with more precision can be provided. According to this invention, a sheet conveying apparatus, a control method of a sheet conveying apparatus, and a control program of a sheet conveying apparatus being able to detect quickly the occurrence of multiple feed can be provided.

The above mentioned processes can be executed by both of software and hardware circuit. A computer program which executes the processes in the above embodiments can be provided. The program may be provided recorded in recording media of CD-ROMs, flexible disks, hard disks, ROMs, RAM, memory cards, or the like to users. The program is executed by a computer of a CPU or the like. The program may be downloaded to a device via communication lines like the internet. The processes explained in the above flowcharts and the description are executed by a CPU in line with the program.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet conveying apparatus comprising:

an upstream side roller to provide a plurality of sheets placed on a placement unit in series to a conveying path;

an upstream side sensor to detect presence or absence of a sheet being conveyed along the conveying path, at a location of a downstream side of the upstream side roller along the conveying path;

an ultrasonic wave sensor to detect presence or absence of occurrence of multiple feed, based on an intensity of ultrasonic waves received at a location of a downstream side of the upstream side sensor along the conveying path;

a downstream side roller provided at a downstream side of the ultrasonic wave sensor along the conveying path, to convey the sheet along the conveying path;

a deviation amount calculation unit to calculate a deviation amount of multiple fed sheets, when the ultrasonic wave sensor detects the multiple feed; and a control unit to control at least a drive state of the upstream side roller, wherein the control unit includes a first change unit to change the drive state of the upstream side roller, after an estimated time at which an anterior end of the sheet is expected to reach a nip portion of the downstream side roller has elapsed, in a case in which the deviation amount is more than a threshold value of the deviation amount, and wherein the first change unit changes the drive state of the upstream side roller such that a relative rotational speed of the upstream side roller with respect to a rotational speed of the downstream side roller is a negative value, with a rotational direction of the downstream side roller being defined as a positive direction.

2. The sheet conveying apparatus according to claim 1, further comprising:

a location prediction unit to predict a location of the sheet along the conveying path, based on a time elapsed from detection of the sheet at the upstream side sensor, wherein the control unit controls at least the drive state of the upstream side roller based on the location of the sheet predicted by the location prediction unit and a detection result of the multiple feed by the ultrasonic wave sensor.

3. The sheet conveying apparatus according to claim 2, wherein the control unit further includes:

a first stop unit to stop conveying the sheet, when the deviation amount is less than the threshold value of the deviation amount.

4. The sheet conveying apparatus according to claim 3, further comprising:

an inform unit to inform about abnormal circumstances of conveying, when the first stop unit stops conveying the sheet.

5. The sheet conveying apparatus according to claim 2, wherein the first change unit changes the drive state of the upstream side roller into at least one of a state in which the upstream side roller reduces its speed, a state in which the upstream side roller stops, and a state in which the upstream side roller rotates in a negative direction.

6. The sheet conveying apparatus according to claim 2, further comprising:

a downstream side sensor to detect presence or absence of the sheet being conveyed along the conveying path, at a location between the ultrasonic wave sensor and the downstream side roller along the conveying path, wherein the control unit further includes:

a second change unit to change the drive state of the upstream side roller, in a case in which the ultrasonic wave sensor does not detect the multiple feed at an estimated time at which a posterior end of the sheet is expected to pass through a detecting location of the upstream side sensor, after the first change unit has changed the drive state of the upstream side roller, and a third change unit to change the drive state of the upstream side roller, in a case in which the downstream side sensor does not detect the sheet at an estimated time at which the posterior end of the sheet is expected to pass through a detecting location of the downstream side sensor, after the second change unit has changed the drive state of the upstream side roller, wherein the second change unit changes the drive state of the upstream side roller such that the relative rotational speed of the upstream side roller with respect to the rotational speed of the downstream side roller approaches zero, and wherein the third change unit changes the drive state of the upstream side roller such that the relative rotational speed of the upstream side roller with respect to the rotational speed of the downstream side roller is reduced to zero.

7. The sheet conveying apparatus according to claim 2, wherein the control unit further includes a second stop unit to stop conveying the sheet, in a case in which the ultrasonic wave sensor detects the multiple feed of the sheet when an estimated time at which a posterior end of the sheet is expected to pass through a detecting location of the upstream side sensor has elapsed, after the first change unit has changed the drive state of the upstream side roller.

8. The sheet conveying apparatus according to claim 2, further comprising:

a downstream side sensor which is placed at a location between the ultrasonic wave sensor and the downstream side roller along the conveying path, and which detects presence or absence of the sheet being conveyed along the conveying path, wherein the control unit further includes a third stop unit to stop conveying the sheet, in a case in which the downstream side sensor detects the sheet when an estimated time at which a posterior end of the sheet is expected to pass through a detecting location of the downstream side sensor has elapsed, after the first change unit has changed the drive state of the upstream side roller.

9. The sheet conveying apparatus according to claim 2, further comprising:

a downstream side sensor which is placed at a location between the ultrasonic wave sensor and the downstream side roller along the conveying path, and which detects presence or absence of the sheet being conveyed along the conveying path, wherein the control unit further includes:

a fourth change unit to change the drive state of the upstream side roller, in a case in which the ultrasonic wave sensor does not detect the multiple feed of the sheet, and the upstream side sensor detects the sheet when an estimated time at which a posterior end of the sheet is expected to pass through a detecting location of the upstream side sensor has elapsed, and a fifth change unit to change the drive state of the upstream side roller, in a case in which the downstream side sensor does not detect the sheet, at an estimated time at which the posterior end of the sheet is expected to pass through the downstream side sensor, after the fourth change unit has changed the drive state of the upstream side roller, wherein the fourth change unit changes the drive state of the upstream side roller such that the relative rotational speed of the upstream side roller with respect to the rotational speed of the downstream side roller is a negative value, with the rotational direction of the downstream side roller being defined as the positive direction, and wherein the fifth change unit changes the drive state of the upstream side roller such that the relative rotational speed of the upstream side roller with respect to the rotational speed of the downstream side roller is reduced to zero.

10. The sheet conveying apparatus according to claim 9, wherein the control unit further includes a fourth stop unit to stop conveying the sheet, in a case in which the downstream side sensor detects the sheet when the estimated time at which the posterior end of the sheet is expected to pass through the downstream side sensor has elapsed, after the fourth change unit has changed the drive state of the upstream side roller.

11. The sheet conveying apparatus according to claim 9, wherein the control unit controls the drive state of the upstream side roller, irrespective of the detection result of the multiple feed by the ultrasonic wave sensor, from when the fourth change unit changes the drive state of the upstream side roller, to when the fifth change unit changes the drive state of the upstream side roller.

12. The sheet conveying apparatus according to claim 2, further comprising:

a downstream side sensor which is placed at a location between the ultrasonic wave sensor and the downstream side roller along the conveying path, and which detects presence or absence of the sheet being conveyed along the conveying path, wherein the control unit further includes:

a sixth change unit to change the drive state of the upstream side roller, in a case in which the upstream side sensor detects the sheet, at an estimated time at which a posterior end of the sheet is expected to pass through the upstream side sensor, and a seventh change unit to change the drive state of the upstream side roller, in a case in which the downstream side sensor does not detect the sheet, at an estimated time at which the posterior end of the sheet is expected to pass through the downstream side sensor, after the sixth change unit has changed the drive state of the upstream side roller, wherein the sixth change unit changes the drive state of the upstream side roller such that the relative rotational speed of the upstream side roller with respect to the rotational speed of the downstream side roller is a negative value, with the rotational direction of the downstream side roller being defined as the positive direction, and wherein the seventh change unit changes the drive state of the upstream side roller such that the relative rotational speed of the upstream side roller with respect to the rotational speed of the downstream side roller is reduced to zero.

13. The sheet conveying apparatus according to claim 12, wherein the control unit further includes a fifth stop unit to stop conveying the sheet, in a case in which the downstream side sensor detects the sheet when the estimated time at which the posterior end of the sheet is expected to pass through the downstream side sensor has elapsed, after the sixth change unit has changed the drive state of the upstream side roller.

14. The sheet conveying apparatus according to claim 1, wherein the deviation amount calculation unit calculates the deviation amount based on a delay of a clock time when the multiple feed was detected by the ultrasonic wave sensor.

15. A method of controlling a sheet conveying apparatus having an upstream side roller to provide a plurality of sheets placed on a placement unit in series to a conveying path, an upstream side sensor, an ultrasonic wave sensor, and a downstream side roller provided at a downstream side of the ultrasonic wave sensor along the conveying path, the method comprising:

detecting, by using the upstream side sensor, presence or absence of a sheet being conveyed along the conveying path, at a location of a downstream side of the upstream side roller along the conveying path;

detecting presence or absence of occurrence of multiple feed, based on an intensity of ultrasonic waves received by the ultrasonic wave sensor at a location of a downstream side of the upstream side sensor along the conveying path;

calculating a deviation amount of multiple fed sheets, when the detecting detects the multiple feed; and controlling at least a drive state of the upstream side roller, wherein the controlling controls to change the drive state of the upstream side roller, after an estimated time at which an anterior end of the sheet is expected to reach a nip portion of the downstream side roller has elapsed, in a case in which the deviation amount calculated in the calculating is more than a threshold value of the deviation amount, and wherein the controlling controls to change the drive state of the upstream side roller such that a relative rotational speed of the upstream side roller with respect to a rotational speed of the downstream side roller is a negative value, with a rotational direction of the downstream side roller being defined as a positive direction.

16. A non-transitory computer-readable recording medium having a program for controlling a sheet conveying apparatus recorded thereon the sheet conveying apparatus having an upstream side roller to provide a plurality of sheets placed on a placement unit in series to a conveying path, an upstream side sensor, an ultrasonic wave sensor, and a downstream side roller provided at a downstream side of the ultrasonic wave sensor along the conveying path, and the program being executable to control a computer of the sheet conveying apparatus to execute functions comprising:

detecting, by using the upstream side sensor, presence or absence of a sheet being conveyed along the conveying path, at a location of a downstream side of the upstream side roller along the conveying path;

detecting presence or absence of occurrence of multiple feed, based on an intensity of ultrasonic waves received by the ultrasonic wave sensor at a location of a downstream side of the upstream side sensor along the conveying path;

calculating a deviation amount of multiple fed sheets, when the detecting detects the multiple feed; and controlling at least a drive state of the upstream side roller, wherein the controlling controls to chance the drive state of the upstream side roller, after an estimated time at which an anterior end of the sheet is expected to reach a nip portion of the downstream side roller has elapsed, in a case in which the deviation amount calculated in the calculating is more than a threshold value of the deviation amount, and wherein the controlling controls to change the drive state of the upstream side roller such that a relative rotational speed of the upstream side roller with respect to a rotational speed of the downstream side roller is a negative value, with a rotational direction of the downstream side roller being defined as a positive direction.

* * * * *